US007806507B2

(12) United States Patent
Matsuoka et al.

(10) Patent No.: US 7,806,507 B2
(45) Date of Patent: Oct. 5, 2010

(54) LIQUID EJECTION APPARATUS, CAPPING DEVICE, AND INSTALLATION DEVICE FOR LIQUID ABSORBER

(75) Inventors: Hiroki Matsuoka, Nagano-ken (JP); Atsushi Yoshida, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 824 days.

(21) Appl. No.: 11/657,597

(22) Filed: Jan. 25, 2007

(65) Prior Publication Data

US 2007/0171254 A1 Jul. 26, 2007

(30) Foreign Application Priority Data

Jan. 25, 2006 (JP) ..... 2006-016499
Jan. 30, 2006 (JP) ..... 2006-020445

(51) Int. Cl.
*B41J 2/165* (2006.01)

(52) U.S. Cl. ..... 347/31; 347/29

(58) Field of Classification Search ..... 347/29, 347/31, 36

See application file for complete search history.

(56) References Cited

U.S. PATENT DOCUMENTS 4,748,459 A * 5/1988 Ichihashi et al. ..... 347/31
6,203,137 B1 3/2001 Niimura et al.
6,550,890 B2 4/2003 Saijo
6,641,250 B2 * 11/2003 Saito ..... 347/31

FOREIGN PATENT DOCUMENTS

| | | |
|---|---|---|
| JP | 07-178928 A | 7/1995 |
| JP | 10-119309 A | 5/1998 |
| JP | 2000-062202 | 2/2000 |
| JP | 2000-103072 A | 4/2000 |
| JP | 2005-066904 A | 3/2005 |
| JP | 2005-169343 A | 6/2005 |
| JP | 2005-226736 A | 8/2005 |

* cited by examiner

*Primary Examiner*—Julian D Huffman
*Assistant Examiner*—Jason S Uhlenhake
(74) *Attorney, Agent, or Firm*—Sughrue Mion, PLLC

(57) ABSTRACT

A capping device provided in a liquid ejection apparatus having a liquid ejection head is provided. The liquid ejection head has a nozzle-forming surface in which a nozzle for ejection liquid is formed. The capping device includes a cap, a liquid absorber, and a fixing member. The cap is capable of contacting the liquid ejection head in such a manner as to encompass the nozzle. The liquid absorber is accommodated in the cap. The fixing member fixes the liquid absorber accommodated in the cap to the cap. The fixing member is arranged in the cap such that an upper end of the fixing member is at the same height as or lower than an upper surface of the liquid absorber.

13 Claims, 12 Drawing Sheets

LIQUID EJECTION APPARATUS, CAPPING DEVICE, AND INSTALLATION DEVICE FOR LIQUID ABSORBER

CROSS-REFERENCE TO RELATED APPLICATIONS

This application is based upon and claims the benefit of priority from prior Japanese Patent Application No. 2006-016499, filed on Jan. 25, 2006 and Japanese Patent Application No. 2006-020445, filed on Jan. 30, 2006, the entire contents of which are incorporated herein by reference.

BACKGROUND

1. Technical Field

The present invention relates to a liquid ejection apparatus such as an inkjet printer, a capping device used in a liquid ejection apparatus, and an installation device for installing a liquid absorber in a cap.

2. Related Art

Typically, an inkjet printer (hereinafter, referred to as printer), which is a type of liquid ejection apparatus, performs printing by ejecting ink (liquid) onto a recording medium from a recording head (liquid ejection head) mounted on a carriage. The recording head has a great number of nozzles for ejection ink, and a piezoelectric element is provided in each of the nozzles. By activating some of the piezoelectric elements, specific ones of the nozzles are filled with ink, and the ink is ejected through the openings of the nozzles. The solvent of the ink in the nozzles is likely to evaporate from the nozzle openings. This increases the viscosity of the ink and can thus clog the nozzles. Also, atmospheric air can enter the interior of the nozzles through the openings, which causes air bubbles to stay in the ink. This results in printing problems such as missing dots.

To avoid such problems, printers as described above are equipped with a cleaning mechanism for a recording head. Such a cleaning mechanism includes a cap for sealing a nozzle-forming surface of the recording head and a suction pump for sucking air out of the cap. In this type of printer, flushing and cleaning are executed as necessary. Flushing refers to ejection of ink from the nozzles through excitement of the piezoelectric elements in response to a control signal unrelated to printing. Cleaning refers to suction of ink from the nozzles using vacuum, which is produced when the nozzle-forming surface is sealed with the cap and the suction pump is activated.

The cleaning mechanism is also capable of preventing the interior of the nozzles from drying by sealing the recording head with the cap when the printer is not performing printing. The cap has a box-like shape, and accommodates ink absorber (liquid absorber) for receiving and absorbing ink discharged from the nozzles during cleaning. Therefore, when the cap seals the recording head, ink solvent evaporated from the ink absorber maintains the moisture in the space surrounded by the cap and the recording head. This prevents the interior of the nozzles from drying.

JP-A-2000-62202 discloses a printer equipped with a capping member (cap) accommodating an ink absorber. The capping member of the printer disclosed in the publication is accommodated in a cap holder, and the ink absorber is accommodated in the capping member. Five pin portions are provided on the bottom in the cap holder. The pin portions are received by insertion holes formed in the capping member and through holes formed in the ink absorber. The distal end (upper end) of each pin portion protrudes upward from the upper surface of the ink absorber. A push plate is heat crimped to the distal ends of the pin portions, so that the push plate and the ink absorber are fixed in the capping member. The ink absorber is thus prevented from being raised off the interior of the cap.

The printer disclosed in JP-A-2000-62202 has a push plate above an ink absorber to prevent the ink absorber from being raised. Therefore, when the nozzle-forming surface of the recording head is sealed with the cap member, the push plate constitutes an impediment and increases the space between the upper surface of the ink absorber and the nozzle-forming surface. That is, even if the recording head is sealed with the cap when the printer is not performing printing, the size of the space defined by the cap and the recording head cannot be reduced. It is therefore impossible to increase the moisture retention of the space. As a result, the interior of the nozzles cannot be prevented from drying.

Also, in the case of JP-A-2000-62202, a push plate needs to be heat crimped to the distal ends of the pin portions, so that the ink absorber is fixed in the capping member. This complicates the installation of the ink absorber. Particularly, if a thin and small ink absorber is used, it tends to be deformed when being installed in the capping member. This further complicates the installation and hinders a heat crimping device from being inserted into the capping member.

SUMMARY

An advantage of some aspects of the present invention is to provide a liquid ejection apparatus and a capping device that prevent a liquid absorber from being raised in a cap, and maintain, when a nozzle-forming surface of a liquid ejection head is sealed with a cap, moisture in the space defined by the nozzle-forming surface and the cap, thereby preventing the interior of nozzles from drying. Another advantage of some aspects of the present invention is to provide an installation device for installing a liquid absorber that prevents a liquid absorber from being raised in a cap, and facilitates the installation of the liquid absorber in the cap.

In accordance with a first aspect of the present invention, a capping device provided in a liquid ejection apparatus having a liquid ejection head is provided. The liquid ejection head has a nozzle-forming surface in which a nozzle for ejection liquid is formed. The capping device includes a cap, a liquid absorber, and a fixing member. The cap is capable of contacting the liquid ejection head in such a manner as to encompass the nozzle. The liquid absorber is accommodated in the cap. The fixing member fixes the liquid absorber accommodated in the cap to the cap. The fixing member is arranged in the cap such that an upper end of the fixing member is at the same height as or lower than an upper surface of the liquid absorber.

In accordance with a second aspect of the present invention, a liquid ejection apparatus including a liquid ejection head and a capping device is provided. The liquid ejection head has a nozzle-forming surface in which a nozzle for ejection liquid is formed. The capping device includes a cap, a liquid absorber, and a fixing member. The cap is capable of contacting the liquid ejection head in such a manner as to encompass the nozzle. The liquid absorber is accommodated in the cap. The fixing member fixes the liquid absorber accommodated in the cap to the cap. The fixing member is arranged in the cap such that an upper end of the fixing member is at the same height as or lower than an upper surface of the liquid absorber.

In accordance with a third aspect of the present invention, an installation device for installing a liquid absorber in a cap of a liquid ejection apparatus is provided. The liquid ejection apparatus includes a liquid ejection head having a nozzle-forming surface in which nozzle for ejecting liquid is formed. The cap is capable of contacting the liquid ejection head in such a manner as to encompass the nozzle. The installation device includes a main body. The installation device main body includes a holding portion for holding the liquid absorber in the cap, and a fixing portion for fixing the installation device main body to the cap in a state where the holding portion holds the liquid absorber.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF EXEMPLARY EMBODIMENTS

A first embodiment of the present invention will now be described with reference to FIGS. 1 to 3B. Unless otherwise specified, a front-and-back direction, an up-and-down direction, and a left-and-right direction agree with a front-and-back direction, an up-and-down direction, and a left-and-right direction as defined in FIG. 1.

Figure 1:
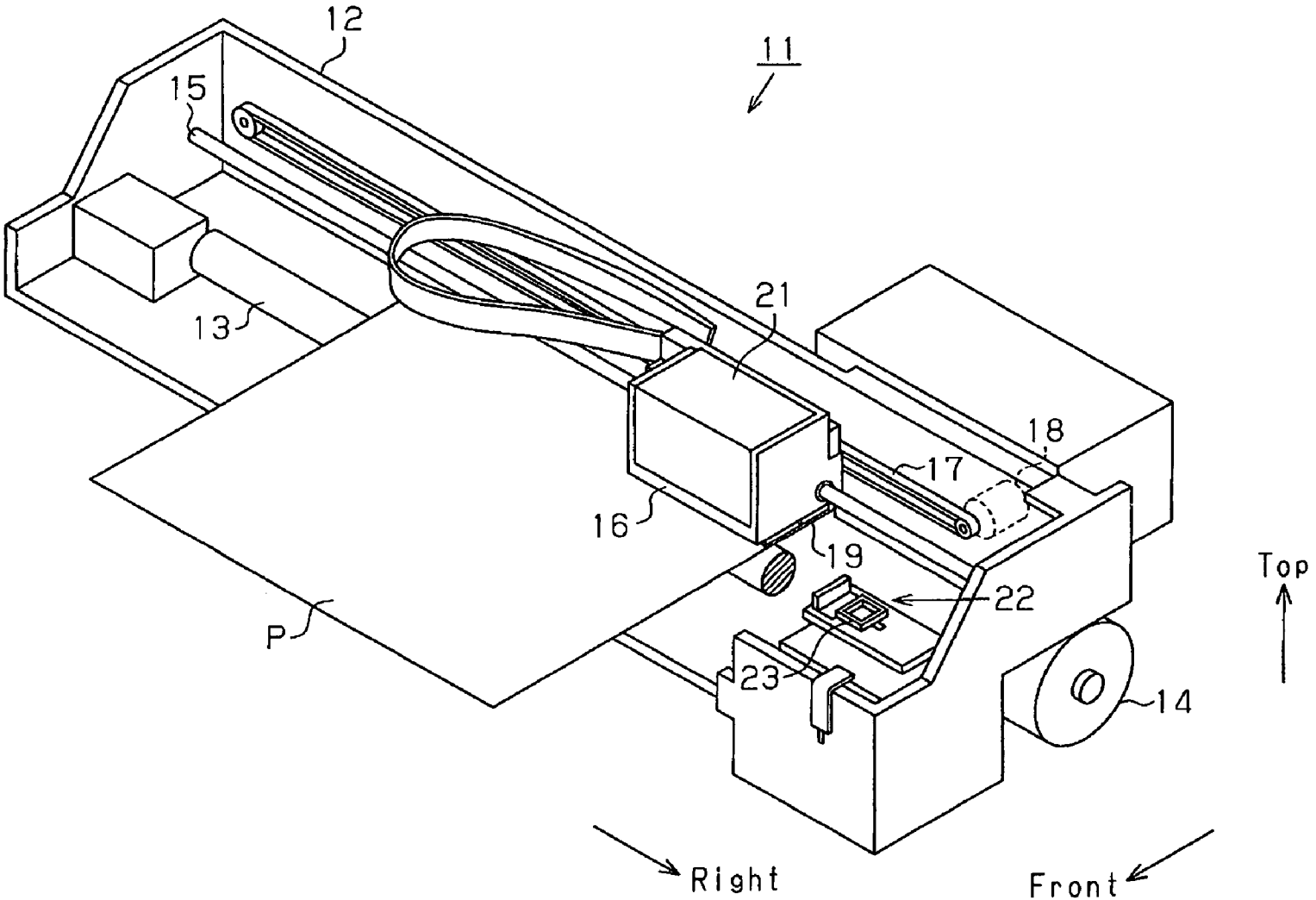
FIG. 1 is a perspective view illustrating an inkjet printer according to a first embodiment of the present invention.

As shown in FIG. 1, an inkjet printer 11, which functions as a liquid ejection apparatus, has a frame 12, which has a rectangular shape as viewed from above. A platen 13 is provided in the frame 12. A paper feed mechanism having a paper feed motor 14 feeds sheets of recording paper P onto the platen 13. A rod-like guide member 15 is supported also by the frame 12 and extends parallel with the longitudinal direction of the platen 13.

A carriage 16 is supported by the guide member 15, which is passed through the carriage 16, so that the carriage 16 reciprocates along the axial direction of the guide member 15. The carriage 16 is connected to a carriage motor 18 located rearward of the frame 12 through a timing belt 17 that is provided on a rear inner wall of the frame 12. When the carriage motor 18 runs, the carriage 16 reciprocates along the guide member 15.

Figure 2:
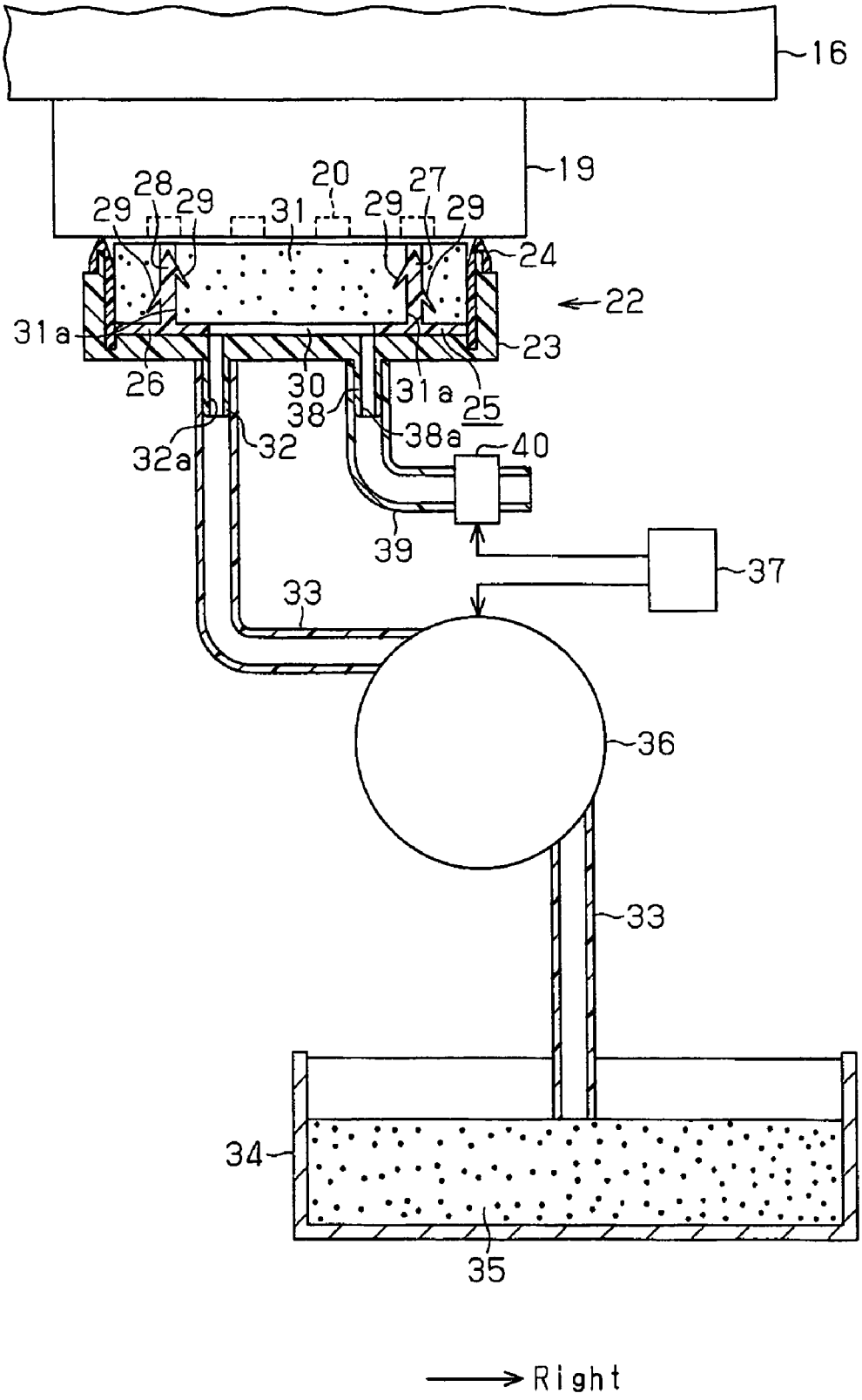
FIG. 2 is a schematic cross-sectional view showing a part of the printer of FIG. 1.

A recording head 19, or a liquid ejection head, is mounted on a bottom surface of the carriage 16. The lower surface of the recording head 19 functions as a nozzle-forming surface 19*a*, in which a number of nozzles 20 (the number is four in this embodiment) are formed as shown in FIG. 2. A detachable ink cartridge 21 is mounted on the carriage 16 above the recording head 19. The ink cartridge 21 stores inks of two or more colors (in this embodiment, four colors). The inks of different colors are supplied to the recording head 19.

The recording head 19 has piezoelectric elements (not shown). When activated, the piezoelectric elements supplies ink from the ink cartridge to the recording head 19. The ink is ejected from the nozzles 20 onto the recording paper sheet P fed to the platen 13. Printing is thus performed. A capping device 22 is provided in a non-printing area at a right end portion of the frame 12. The capping device 22 seals the nozzle-forming surface 19*a* of the recording head 19 in a non-printing state.

Figure 3A:
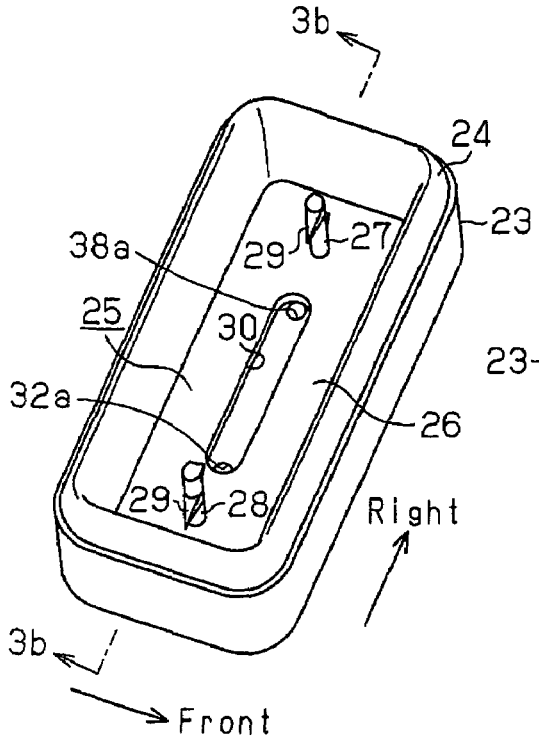
FIG. 3A is a perspective view showing a cap of a printer of FIG. 1.
Figure 3B:
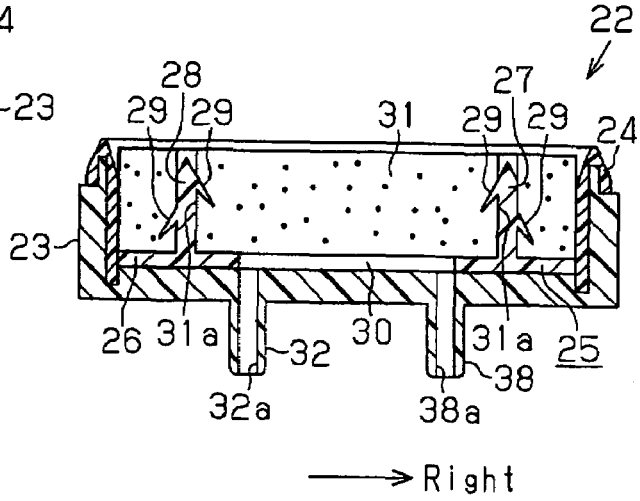
FIG. 3B is a cross-sectional view taken along line 3*b*-3*b* of FIG. 3A, showing a state in which an ink absorber is accommodated in the cap of FIG. 3A.

As shown in FIGS. 2, 3A, and 3B, the capping device 22 has a cap 23 shaped as a rectangular box with a closed bottom. The cap 23 is capable of sealing the nozzle-forming surface 19*a* of the recording head 19. When sealing the nozzle-forming surface 19*a*, the cap 23 contacts the recording head 19 in such a manner as to encompass the nozzles 20. A rubber sealing member 24 having a rectangular frame-like shape is provided in the cap 23 to cover the inner side surface and the upper end of the cap 23. A piercing member 25 functioning as a fixing member is located in the cap 23. The piercing member 25 is made of a hard synthetic resin, and includes a rectangular plate-like base 26 and columnar left and right piercing portions 27, 28 projecting from the base 26. That is, the piercing member 25 is symmetric. The piercing member 25 is press fitted in the cap 23 until the base 26 contacts the inner bottom surface of the cap 23, so that the piercing member 25 is fixed to the cap 23.

The right piercing portion 27 and the left piercing portion 28 are located in right and left sections, respectively, in a center portion with respect to the front-and-back direction in the cap 23. The upper ends (distal ends) of the piercing portions 27; 28 are pointed like cones. A pointed barb portion 29 projecting diagonally downward left is provided in each of the left side of the upper end of the right piercing portion 27 and the left side of the lower end of the left piercing portion 28. A pointed barb portion 29 projecting diagonally downward right is provided in each of the right side of the lower end of the right piercing portion 27 and the right side of the upper end of the left piercing portion 28. A long hole 30 extending in the left-and-right direction is formed in a center of the base 26 between the piercing portions 27, 28. The long hole 30 is formed through the base 26 along the up-and-down direction.

A rectangular parallelepiped ink absorber 31, or a liquid absorber the shape of which substantially corresponds to the shape of the interior of the cap 23, is accommodated in the cap 23. The ink absorber 31 is made of a flexible porous material. Vertically extending piercing holes 31*a* are formed in the ink absorber 31 at positions corresponding to the piercing portions 27, 28, respectively. The inner diameter of the piercing holes 31*a* is slightly less than the outer diameter of the piercing portions 27, 28.

In the cap 23, the piercing portions 27, 28 are engaged with the ink absorber 31. Specifically, the piercing portions 27, 28 are inserted in the piercing holes 31*a* in a piercing manner, and the barb portions 29 are substantially entirely engaged with the inner circumferential surfaces of the piercing holes 31*a*, thereby locking the ink absorber 31. The piercing portions 27, 28 are designed such that the upper ends are lower than the upper surface of the ink absorber 31 in this state. The upper surface of the ink absorber 31 is set lower than the upper end of the rubber sealing member 24.

When the carriage 16 is in the non-printing area, the capping device 22 lifts the cap 23 using a lift mechanism (not shown), so that the upper end of the rubber sealing member 24 contacts the nozzle-forming surface 19*a* of the recording head 19. The nozzles 20 are thus sealed with the cap 23. When the cap 23 seals the nozzle-forming surface 19*a*, the ink absorber 31 retaining ink in the cap 23 maintains moisture in the cap 23.

The difference in height between the upper surface of the ink absorber 31 and the upper end of the rubber sealing member 24 is set to such a value that, when the cap 23 seals the nozzle-forming surface 19*a*, the upper surface of the ink absorber 31 contacts ink droplets collected on the nozzle-forming surface 19*a*, and that the upper surface of the ink absorber 31 does not contact the nozzle-forming surface 19*a*.

A drainage portion 32 for draining ink in the cap 23 projects downward from the bottom wall of the cap 23 at a position corresponding to the left end of the long hole 30 of the piercing member 25. A drainage passage 32*a* is defined in the drainage portion 32. A proximal end (upstream end) of a drainage tube 33 made of a flexible material is connected to the drainage portion 32. The drainage passage 32*a* connects the interior of the cap 23 with the interior of the drainage tube 33.

A distal end (downstream end) of the drainage tube 33 is placed in a rectangular box-shaped waste ink tank 34 having an open upper end. A waste ink absorber 35 made of a rectangular parallelepiped porous material is accommodated in the waste ink absorber 35. A tube pump 36 is provided in an intermediate portion of the drainage tube 33. The tube pump 36 sends ink and bubbles in the ink from the cap 23 to the waste ink tank 34.

The tube pump 36 is electrically connected to a control section 37, which controls the operation state of the inkjet printer 11, such that the tube pump 36 is controlled by the control section 37. Then, with the nozzle-forming surface 19*a* (the nozzles 20) of the recording head 19 being sealed with the cap 23, the tube pump 36 is activated so that viscous ink is drawn out of the nozzles 20 together with bubbles. The ink and bubbles are drained to the waste ink tank 34 through the cap 23 and the drainage tube 33. This process is referred to as head cleaning.

An atmosphere communicating portion 38 for connecting the interior of the cap 23 with the outside air (atmosphere) projects downward from the bottom wall of the cap 23 at a position corresponding to the right end of the long hole 30 of the piercing member 25. An atmosphere communicating passage 38*a* is defined in the atmosphere communicating portion 38. A proximal end of an atmosphere communicating tube 39 made of a flexible material is connected to the atmosphere communicating portion 38. The atmosphere communicating passage 38*a* connects the interior of the cap 23 with the interior of the atmosphere communicating tube 39.

An atmosphere communicating valve 40 is provided at the distal end of the atmosphere communicating tube 39. The atmosphere communicating valve 40 is electrically connected to the control section 37. The control section 37 controls the atmosphere communicating valve 40. When the atmosphere communicating valve 40 is open, the interior of the atmosphere communicating tube 39 communicates with the atmosphere. When the atmosphere communicating valve 40 is closed, the interior of the atmosphere communicating tube 39 is disconnected from the atmosphere.

The operation of the inkjet printer 11 constructed as above will now be described.

When executing the head cleaning of the recording head 19, the carriage 16 is moved to the non-printing area, and the cap 23 is lifted to seal the nozzle-forming surface 19*a* (the nozzles 20) of the recording head 19. At the same time, the atmosphere communicating valve 40 is closed. The tube pump 36 is activated in this state so that vacuum is created in the cap 23. The vacuum sucks thickened ink in the nozzles 20 together with bubbles, and the ink is drained to the waste ink tank 34 via the cap 23 and the drainage tube 33. Thereafter, the tube pump 36 is stopped, and the atmosphere communicating valve 40 is opened. This removes the vacuum in the cap 23, and the head cleaning is complete.

If the piercing member 25 is configured such that the upper ends of the piercing portions 27, 28 are higher than the upper surface of the ink absorber 31 in the cap 23, viscous ink will remain on the upper ends of the piercing portions 27, 28 of the piercing member 25 when executing the head cleaning. However, in the present embodiment, since the upper ends of the piercing portions 27, 28 of the piercing member 25 are lower than the upper surface of the ink absorber 31 in the cap 23, viscous ink that has been sucked out of the nozzles 20 does not remain on the upper ends of the piercing portions 27, 28 of the piercing member 25 when executing the head cleaning.

When absorbing ink, the ink absorber 31 tends to expand and move upward (to be raised), this movement is reliably suppressed by the barb portions 29 of the piercing member 25 since the barb portions 29 are locked to the ink absorber 31 while being stuck diagonally downward with respect to the ink absorber 31.

Also, when executing flushing during printing, the carriage 16 is moved to the non-printing area and stopped at a position directly above the cap 23. Then, the cap 23 is lifted so that the cap 23 approaches but does not contact the nozzle-forming surface 19*a* (the nozzles 20) of the recording head 19. In this state, the nozzles 20 are caused to eject ink into the cap 23.

If, the upper ends of the piercing portions 27, 28 of the piercing member 25 are higher than the upper surface of the ink absorber 31 in the cap 23, the ink ejected into the cap 23 hits the piercing member 25 and splatters. The splattered ink contaminates the nozzle-forming surface 19*a*. However, in the present embodiment, the upper ends of the piercing portions 27, 28 of the piercing member 25 are lower than the upper surface of the ink absorber 31 in the cap 23. Thus, even if the ink ejected into the cap 23 splatters on the upper ends of the piercing portions 27, 28, the splattered ink is unlikely to be adhered to the nozzle-forming surface 19*a*.

Particularly, in the present embodiment, the upper ends of the piercing portions 27, 28 are pointed like cones. Thus, even if ink ejected into the cap 23 splatters on the upper ends of the piercing portions 27, 28, most of the splattered ink hits the inner circumferential surface of the piercing holes 31*a* and is absorbed by the ink absorber 31. That is, even if the ink ejected into the cap 23 splatters on the upper ends of the piercing portions 27, 28, the splattered ink is reliably prevented from collecting on the nozzle-forming surface 19*a*. Also, ink that has been ejected into the cap 23 and splattered on the upper surface of the ink absorber 31, which is made of a flexible porous material, is absorbed by the ink absorber 31 without splattering. Thus, the ink does not collect on the nozzle-forming surface 19*a* of the recording head 19.

Further, when the inkjet printer 11 is not used, the nozzle-forming surface 19*a* (the nozzles 20) of the recording head 19 is normally sealed with the cap 23 while opening the atmosphere communicating valve 40, thereby preventing the interior of the nozzles 20 from drying. In this case, since the ink absorber 31 retains the ink ejected from the nozzles 20 during flushing or head cleaning, the ink absorber 31 maintains moisture in the cap 23. That is, when the cap 23 seals the nozzle-forming surface 19*a* of the recording head 19, the ink solvent evaporated from the ink absorber 31 maintains moisture in the space between the upper surface of the ink absorber 31 and the nozzle-forming surface 19*a*.

If the piercing member 25 is configured such that the upper ends of the piercing portions 27, 28 are higher than the upper surface of the ink absorber in the cap 23, the piercing member 25 prevents the upper surface of the ink absorber 31 from being brought to the minimum distance position with respect to the nozzle-forming surface 19*a*. However, since the upper ends of the piercing portions 27, 28 are lower than the upper surface of the ink absorber in the cap 23 in the present embodiment, the upper surface of the ink absorber 31 can be brought to the minimum distance position with respect to the nozzle-forming surface 19*a*.

Therefore, when the cap 23 seals the nozzle-forming surface 19*a* of the recording head 19, the space between the upper surface of the ink absorber 31 and the nozzle-forming surface 19*a* is smaller than the case where the upper ends of the piercing portions 27, 28 of the piercing member 25 is higher than the upper surface of the ink absorber 31. This reliably maintains moisture in the space.

The first embodiment has the following advantages.

(1) The ink absorber 31 tends to expand and be raised in the cap 23 when absorbing ink. However, since the piercing member 25, which pierces and locks the ink absorber 31, is provided in the cap 23, the ink absorber 31 is prevented from being raised in the cap 23. Further, the piercing member 25 is configured such that the upper ends of the piercing portions 27, 28 are lower than the upper surface of the ink absorber 31 in the cap 23. Therefore, when the cap 23 seals the nozzle-forming surface 19*a* of the recording head 19, the upper surface of the ink absorber 31 can be brought to the minimum distance position with respect to the nozzle-forming surface 19*a* without being hindered by the piercing member 25. Therefore, the space defined by the nozzle-forming surface 19*a* of the recording head 19 and the cap 23 is made as small as possible. The moisture in the space is ensured so that the interior of the nozzles 20 is reliably prevented from drying.

When ink is sucked out of the nozzles 20, ink droplets can collect on the nozzle-forming surface 19*a*. In this case, the upper surface of the ink absorber 31 is brought toward the nozzle-forming surface 19*a* to a position where the upper surface of the ink absorber 31 contacts ink droplets collected on the nozzle-forming surface 19*a*, but does not contact the nozzle-forming surface 19*a*. Thus, the ink droplets on the nozzle-forming surface 19*a* are reliably removed by the ink absorber 31. Therefore, backflow of ink into the nozzles and mixture of inks of different colors are prevented.

Also, for example, when the nozzle-forming surface 19*a* is wiped with a wiping device (hot shown), since only small amount of ink has collected on the nozzle-forming surface 19*a*, little ink litters when the wiping device leaves the nozzle-forming surface 19*a*.

(2) The upper ends of the piercing portions 27, 28 of the piercing member 25 are lower than the upper surface of the ink absorber 31 in the cap 23. Thus, even if the ink ejected into the cap 23 splatters on the upper ends of the piercing portions 27, 28, the splattered ink is unlikely to be adhered to the nozzle-forming surface 19*a*.

In this case, the upper ends of the piercing portions 27, 28 are pointed like cones. Thus, even if ink ejected into the cap 23 splatters on the upper ends of the piercing portions 27, 28, most of the splattered ink is absorbed by the ink absorber 31 through the inner circumferential surface of the piercing holes 31*a*. Therefore, even if the ink ejected into the cap 23 splatters on the upper ends of the piercing portions 27, 28, the splattered ink is reliably prevented from collecting on the nozzle-forming surface 19*a*.

(3) In the capping device 22, the ink absorber 31 is easily fixed to the cap 23 by simply piercing the piercing portions 27, 28 of the piercing member 25 into the ink absorber 31. Thus, when fixing the ink absorber 31 in the cap 23, a complicated heat crimping procedure as in JP-A-2000-62202 is not required.

(4) Since the ink absorber 31 has the piercing holes 31*a* for receiving the piercing portions 27, 28 when piercing the piercing portions 27, 28 into the ink absorber 31, the piercing portions 27, 28 are easily pierced in the ink absorber 31. Also, the position of the ink absorber 31 in the cap 23 is determined.

(5) The piercing portions 27, 28 of the piercing member 25 have the barb portions 29 that project diagonally downward in directions intersecting the piercing direction and prevent the ink absorber 31 from separating from the piercing portions 27, 28 pierced from below. Therefore, when the ink absorber 31 is raised, the barb portions 29 pierce further into the ink absorber 31. The ink absorber 31 is reliably prevented from being raised.

A second embodiment of the present invention will now be described. The differences from the first embodiment will mainly be discussed.

Figure 4A:
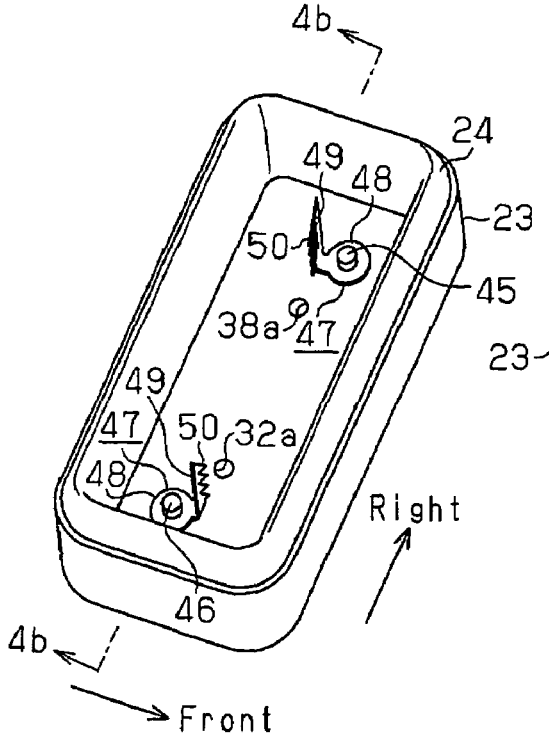
FIG. 4A is a perspective view illustrating a cap according to a second embodiment of the present invention.
Figure 4B:
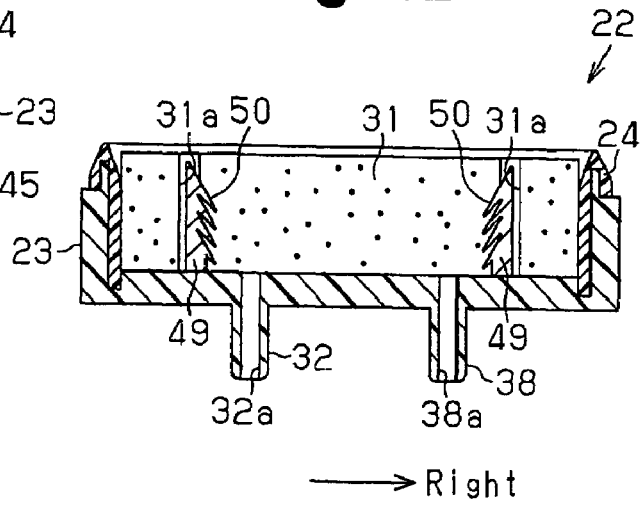
FIG. 4B is a cross-sectional view taken along line 4*b*-4*b* of FIG. 4A, showing a state in which an ink absorber is accommodated in the cap of FIG. 4A.

As shown in FIGS. 4A and 4B, a cap 23 of the second embodiment has on its inner bottom surface columnar right and left projections 45, 46 in a right end area and a left end area, respectively. On the inner bottom surface of the cap 23, the right projection 45 is located slightly frontward of the center in the front-and-back direction, while the left projection 46 is located slightly rearward of the center in the front-and-back direction. That is, the right projection 45 and the left projection 46 are symmetrical with respect to a center point of the inner bottom surface of the cap 23.

Piercing members 47, which form fixing members of the second embodiment, are made of stainless steel plates. Each piercing member 47 has an annular base 48 and a piercing portion 49 projecting at one end of the base 48. The distal end of each piercing portion 49 is triangular and pointed. The piercing portion 49 has on one side sawtooth-like barb portions 50. The piercing members 47 are fixed in the cap 23 by press fitting the annular bases 48 of the piercing members 47 about the right and left projections 45, 46.

The piercing members 47 are arranged such that barb portions 50 of the piercing portions 49 face each other. The piercing portions 49, the drainage passage 32*a*, and the atmosphere communicating passage 38*a* are located on a common line (line that divides the cap 23 in half with respect to the front-and-back direction) as viewed from above. The ink absorber 31 is accommodated in the cap 23 with the piercing portions 49 piercing, the piercing holes 31*a*. In this case, the height of the upper ends of the piercing portions 49 are set lower than the upper surface of the ink absorber 31.

In addition to the above described advantages (1) to (5), the second embodiment provides the following advantages.

(6) The piercing members 47, which are made of stainless steel plates, resist rust even when exposed to ink. Also, the piercing members 47 are inexpensive and easy to manufacture.

(7) The base 48 of each piercing member 47 has a smaller area than that of the base 26 of the piercing member 25 according to the first embodiment. Therefore, the costs for the plate material for manufacturing the piercing members 47 are reduced.

A third embodiment of the present invention will now be described. The differences from the first embodiment will mainly be discussed.

Figure 5A:
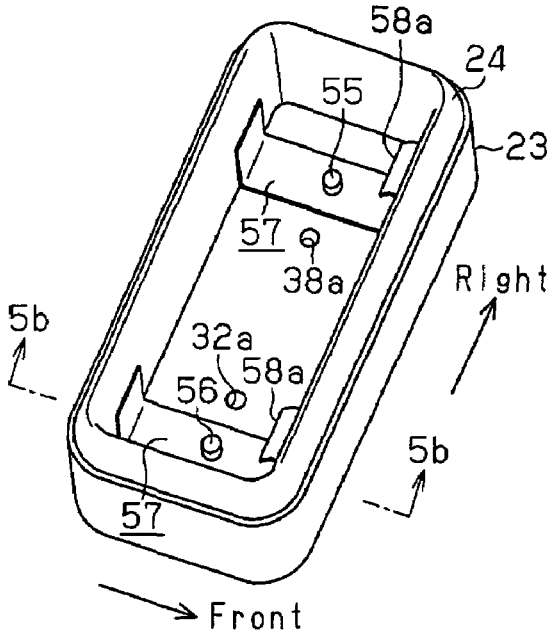
FIG. 5A is a perspective view illustrating a cap according to a third embodiment of the present invention.
Figure 5B:
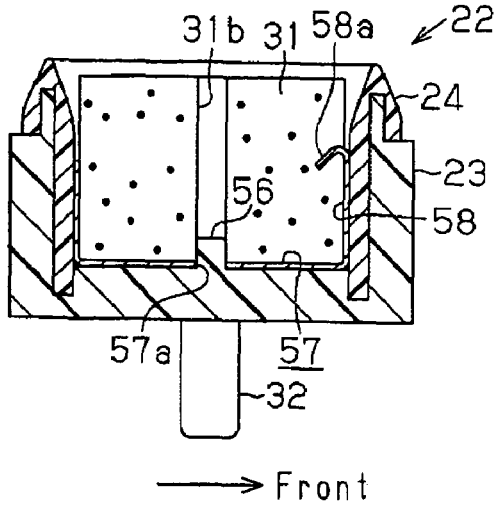
FIG. 5B is a cross-sectional view taken along line 5*b*-5*b* of FIG. 5A, showing a state in which an ink absorber is accommodated in the cap of FIG. 5A.

As shown in FIGS. 5A and 5B, a cap 23 of the third embodiment has on its inner bottom surface columnar right and left projections 55, 56 in a right end area and a left end area, respectively. Holding members 57, which form fixing members of the third embodiment, are made of stainless steel bands. Front and rear ends of each holding member 57 are bent upward substantially perpendicularly. The holding member 57 is thus shaped as a channel with an upper opening as viewed from the left side.

A circular through hole 57*a* is formed in a center of each holding member 57 with respect to the front-and-back direction. The upper end of a front bent portion 58 of each holding member 57 is folded diagonally rearward and downward to form a barb portion 58*a*. By press fitting the right and left projections 55, 56 in the through holes 57*a* of the holding members 57, the holding members 57 are fixed to the cap 23 to contact the front inner surface, the inner bottom surface, and the rear inner surface of the cap 23.

The right projection 55, the left projection 56, the drainage passage 32*a*, and the atmosphere communicating passage 38*a* are located on a common line as viewed from above (on a line that divides the cap 23 in half with respect to the front-and-back direction). Vertically extending insertion holes 31*b* are formed in the ink absorber 31 at positions corresponding to the right projection 55 and the left projection 56, respectively. The inner diameter of the insertion holes 31*b* is slightly larger than the outer diameter of the right and left projections 55, 56.

The ink absorber 31 is accommodated in the cap 23 with the right and left projections 55, 56 being inserted in the insertion holes 31*b*. In this case, the barb portions 58*a* of the holding members 57 pierce into the front side of the ink absorber 31. The height of the upper ends of the holding members 57 are set lower than the upper surface of the ink absorber 31.

In addition to the above described advantages (1) to (5), the third embodiment provides the following advantages.

(8) The barb portions 58*a* are formed at the upper end of the front bent portions 58 of the holding members 57. That is, the barb portions 58*a* are located at the front end in the cap 23. Therefore, if the ink absorber 31 is inserted into the cap 23 from above and behind, the ink absorber 31 is easily fixed in the cap 23.

A fourth embodiment of the present invention will now be described. The differences from the first embodiment will mainly be discussed.

Figure 6A:
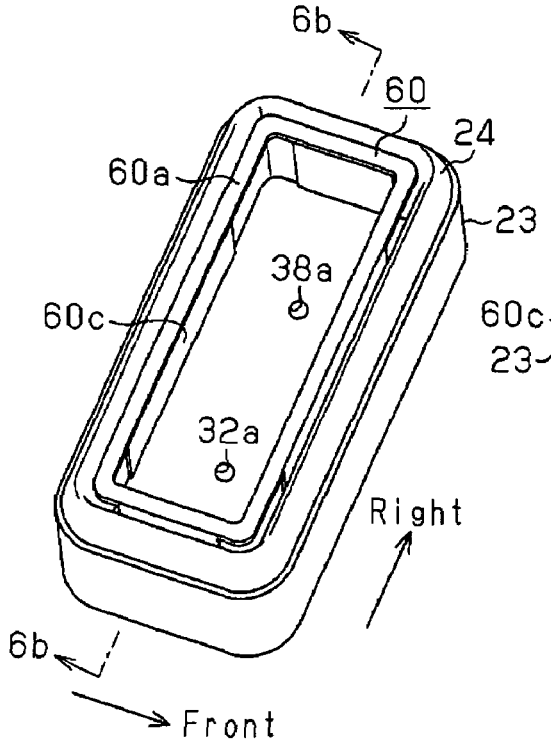
FIG. 6A is a perspective view illustrating a cap according to a fourth embodiment of the present invention.
Figure 6B:
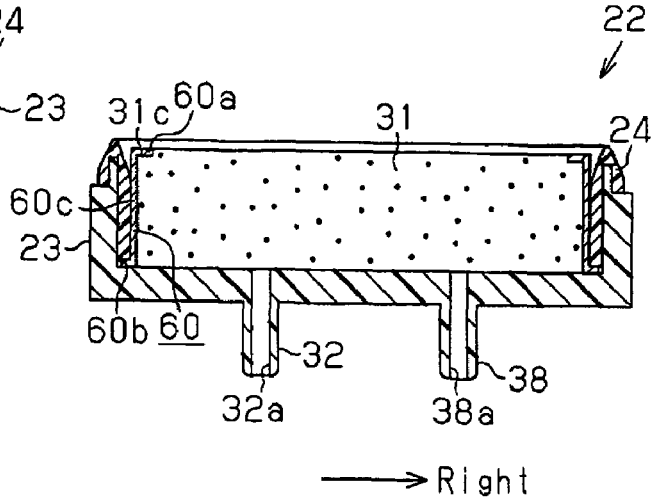
FIG. 6B is a cross-sectional view taken along line 6*b*-6*b* of FIG. 6A, showing a state in which an ink absorber is accommodated in the cap of FIG. 6A.

As shown in FIGS. 6A and 6B, a rectangular frame-like holding member 60, which functions as a fixing member, is accommodated in a cap 23 of the fourth embodiment. The holding member 60 lies along the inner surfaces of the cap 23. The holding member 60 is formed of a stainless steel plate. The holding member 60 has an inner flange 60*a* formed at the upper end, an outer flange 60*b* formed at the lower end, and a rectangular frame-like connecting portion 60*c* that connects the proximal end (outer end) of the inner flange 60*a* and the proximal end (inner end) of the outer flange 60*b*.

The inner flange 60*a* is formed on the entire holding member 60. The outer flange 60*b* and the connecting portion 60*c* are formed at sections of the holding member 60 other than the corners. That is, the outer flange 60*b* and the connecting portion 60*c* are not formed at the corners of the holding member 60.

The holding member 60 is fixed in the cap 23 by inserting the outer flange 60*b* in spaces between the lower surface of the rubber sealing member 24 and the inner bottom surface of the cap 23. A step 31*c* is formed in a periphery of the upper surface of the ink absorber 31. The step 31*c* corresponds to the inner flange 60*a* of the holding member 60. The inner flange 60*a* engages with (locks) the step 31*c*. The engagement (locking) prevents the ink absorber 31 from moving upward (being raised). The upper surface of the ink absorber 31 and the upper surface of the inner flange 60*a* of the holding member 60 are flush with each other.

The fourth embodiment has the following advantages.

(9) Since the inner flange 60*a* of the holding member 60 is only engaged with (locks) the step 31*c* of the ink absorber 31, the ink absorber 31 is prevented from moving upward (being raised) without damaging the ink absorber 31.

A fifth embodiment of the present invention will now be described. The differences from the first embodiment will mainly be discussed.

Figure 7A:
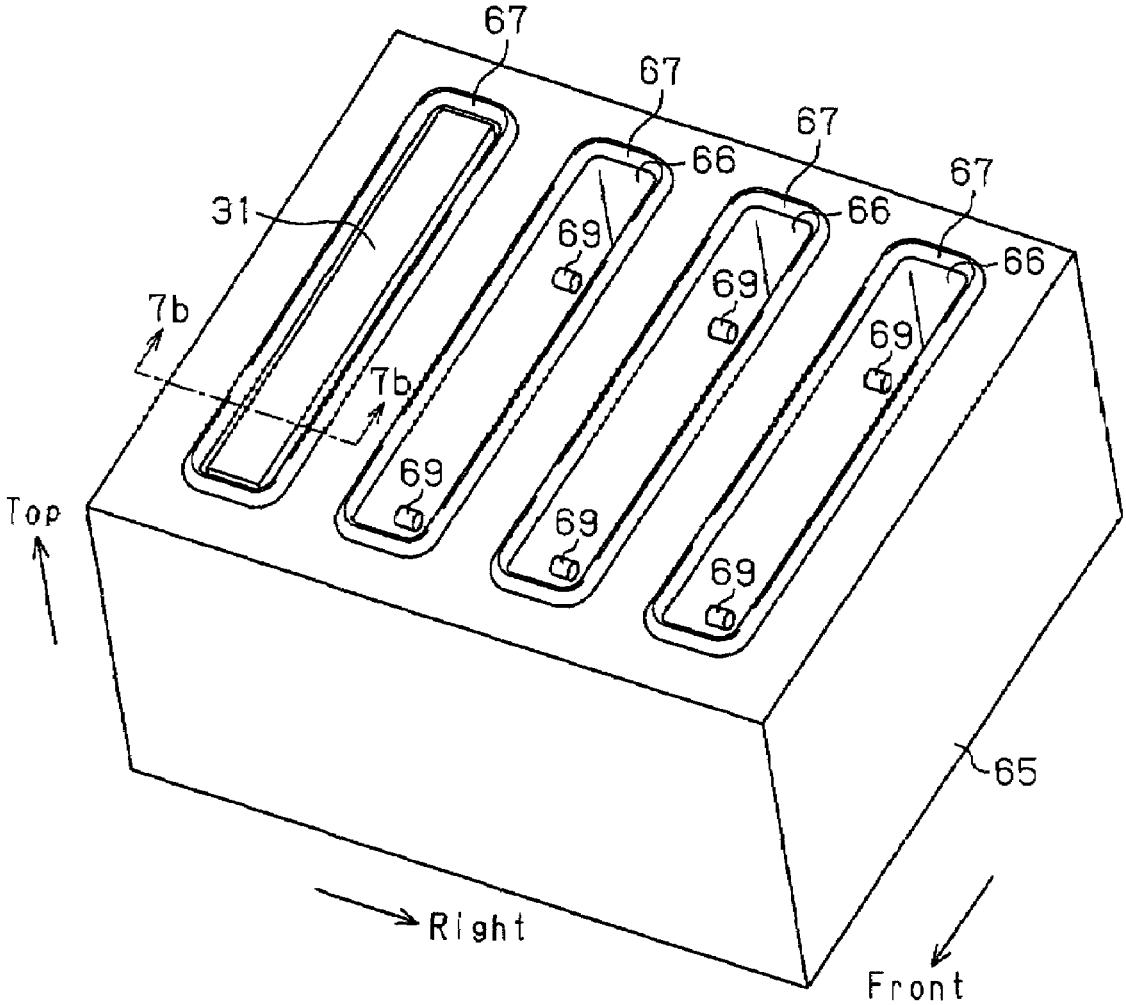
FIG. 7A is a perspective view illustrating a cap according to a fifth embodiment of the present invention.
Figure 7B:
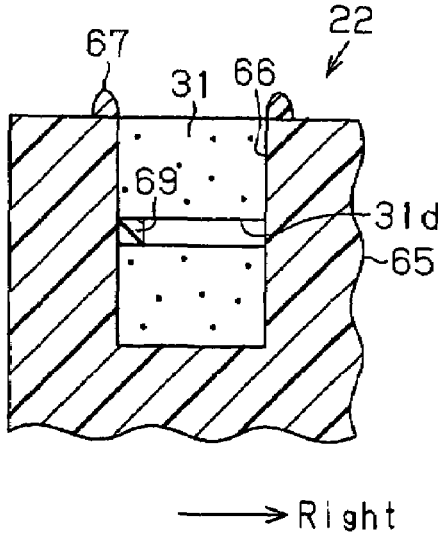
FIG. 7B is a cross-sectional view taken along line 7*b*-7*b* of FIG. 7A.

As shown in FIGS. 7A and 7B, a cap 65 according to the fifth embodiment has a shape different from the cap 23 according to the first embodiment. That is, the cap 65 is a rectangular parallelepiped and has four rectangular cap recesses 66 to correspond to four nozzles 20. An atmosphere communicating portion 38 and a drainage portion 32 are provided in a lower end of the cap 65 to correspond to each cap recess 66.

Sealing members 67 project on the upper surface of the cap 65 to surround each cap recess 66. Projections 69 functioning as fixing members that extend rightward are formed in a center portion with respect to the up-and-down direction on the left inner surface of each cap recess 66. The projections 69 are spaced at a predetermined distance along the front-and-rear direction. The sealing members 67 and the projections 69 are made of a flexible material such as rubber.

Ink absorbers 31 are rectangular parallelepipeds to correspond to the cap recesses 66. Each absorber 31 has insertion holes 31*d*, which correspond to the projections 69 when the ink absorber 31 is accommodated in a cap recess 66. The insertion holes 31*d* extend through each ink absorber 31 in the left-and-right direction. When the ink absorbers 31 are accommodated in the cap recesses 66, the upper surface of the cap 65 and the upper surfaces of the ink absorbers 31 are flush with each other.

When the ink absorbers 31 are inserted in the cap recesses 66, the projections 69 are pushed by the ink absorbers 31 and are temporarily elastically deformed. Thereafter, the projections 69 return to the original positions so as to enter the insertion holes 31*d*. The engagement (locking) of the projections 69 and the insertion holes 31*d* achieved by the insertion determines the position of the ink absorbers 31 and prevents the ink absorbers 31 from moving upward. That is, each ink absorber 31 is fixed in the corresponding cap recess 66.

The fifth embodiment has the following advantages.

(10) Each ink absorber 31 is fixed in the corresponding cap recess 66 by using the projections 69 projecting on the left inner surface of the cap recess 66, without providing any additional parts.

(11) Since no holes or other members are provided on the upper surface of each ink absorber 31, the upper surface of the ink absorber 31 is flat.

A sixth embodiment of the present invention will now be described. The differences from the first embodiment will mainly be discussed.

Figure 8A:
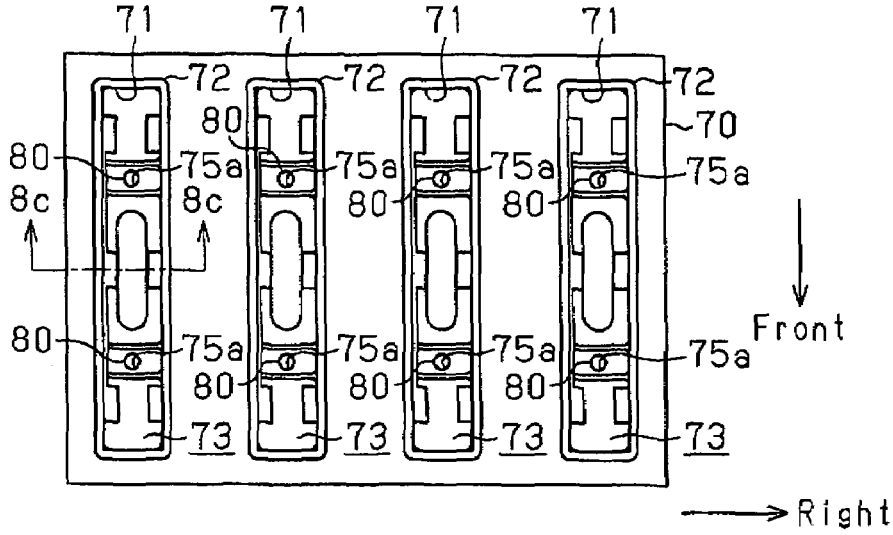
FIG. 8A is a plan view illustrating a cap according to a sixth embodiment of the present invention.
Figure 8B:
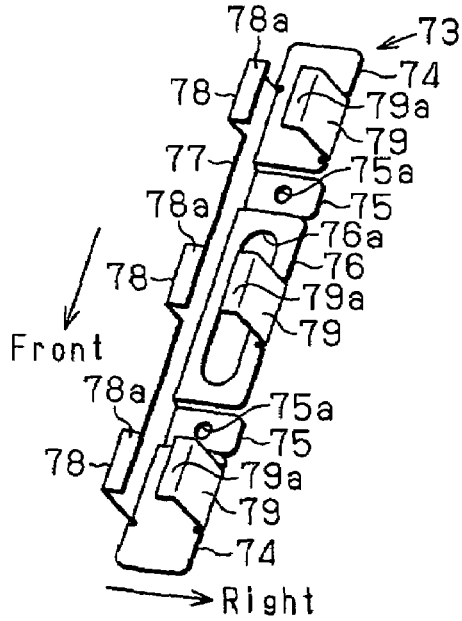
FIG. 8B is a perspective view showing a fixing member according to the sixth embodiment.

As shown in FIGS. 8A and 8B, a cap 70 according to the sixth embodiment has a shape different from the cap 23 according to the first embodiment. That is, the cap 70 is rectangular as viewed from above and has four rectangular cap recesses 71 to correspond to four nozzles 20. An atmosphere communicating portion 38 and a drainage portion 32 are provided in a lower end of the cap 70 to correspond to each cap recess 71. Sealing members 72 made of a flexible material such as rubber project on the upper surface of the cap 70 to surround each cap recess 71. A fixing member 73 is located on the inner bottom surface of each cap recess 71 for fixing the ink absorber 31 in the cap recess 71.

Each fixing member 73 has front and rear rectangular outer plates 74, front and rear rectangular attachment plate 75 located inside of the outer plates 74, and a center plate 76 located between the attachment plates 75. The outer plates 74, the attachment plates 75, and the center plate 76 have the same width in the left-and-right direction. The outer plates 74 and the center plate 76 are at the same height. The attachment plates 75 is lightly lower than the outer plates 74 and the center plate 76.

The length of the center plate 76 along the front-and-back direction is longer than the length of each outer plate 74 along the front-and-back direction. The length of each outer plate 74 along the front-and-back direction is longer than the length of each attachment plate 75 along the front-and-back direction. The outer plates 74, the attachment plates 75, and the center plate 76 are integrated by a rectangular coupler plate 77 that is located at the left side of and extends perpendicularly to the plates 74, 75, 76. That is, the right side of the lower end of the coupler plate 77 is coupled to the left sides of the outer plates 74, the attachment plates 75 and the center plate 76.

The rear end of the coupler plate 77 is located frontward of the rear end of the rear outer plate 74, and the front end of the coupler plate 77 is located rearward of the front end of the front outer plate 74. A plate-like left arm 78 projects from each of rear, center and front portions of the coupler plate 77. The upper end of each left arm 78 is bent perpendicularly rightward to form a left bent portion 78*a*.

A plate-like right arm 79 projects from each of right end portions of the outer plates 74 and the center plate 76. The right arms 79 correspond to the left arms 78. The upper end of each right arm 79 is bent perpendicularly leftward to form a right bent portion 79*a*. The left arms 78 and the right arms 79 have the same width along the front-and-back direction. A predetermined gap exits between each left bent portion 78*a* and the corresponding right bent portion 79*a*. A long hole 76*a* extending along the front-and-back direction is formed in a center of the center plate 76. An attachment hole 75*a* is formed in a center of each attachment plate 75.

Also, attachment pins 80 project from the inner bottom surface of each cap recess 71 to correspond to the attachment holes 75*a* of the attachment plates 75. The attachment pins 80 are press fitted in the attachment holes 75*a* so that the fixing member 73 is fixed to the inner bottom surface of the cap recess 71.

Figure 8C:
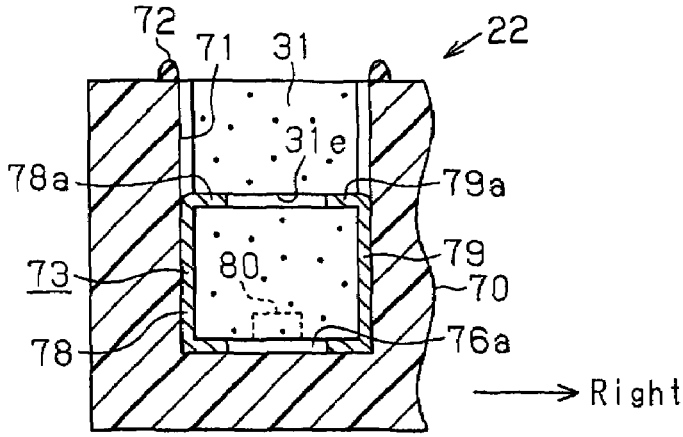
FIG. 8C is a cross-sectional view taken along line 8*b*-8*b* of FIG. 8A, showing a state in which an ink absorber is accommodated in the cap of FIG. 8A.

As shown in FIG. 8C, the ink absorbers 31 are rectangular parallelepipeds to correspond to the cap recesses 71. Each absorber 31 has insertion holes 31*e*, which correspond to the left bent portions 78*a* and the right bent portions 79*a* of the fixing member 73 when the ink absorber 31 is accommodated in the cap recess 71. The insertion holes 31*e* extend through each ink absorber 31 in the left-and-right direction.

When the ink absorbers 31 are inserted in the cap recesses 71, the lower surface of each ink absorber 31 contacts the upper surfaces of the corresponding left bent portions 78*a* and right bent portions 79*a*. When the ink absorber 31 is pushed further, the ink absorber 31 is pressed into the cap recess 71 through the gap between the left and right bent portions 78*a*, 79*a* while being flexed until the lower surface of the ink absorber 31 contacts the bottom of the cap recess 71.

Thereafter, when the flexed ink absorber 31 returns to it original shape, the left and right bent portions 78*a*, 79*a* are inserted in the insertion holes 31*e*. The locking achieved by the insertion determines the position of the ink absorber 31 and prevents the ink absorber 31 from moving upward. That is, each ink absorber 31 is fixed in the corresponding cap recess 71.

The sixth embodiment provides the same advantage as the above described advantage (11).

A seventh embodiment of the present invention will now be described. The differences from the sixth embodiment will mainly be discussed.

Figure 9A:
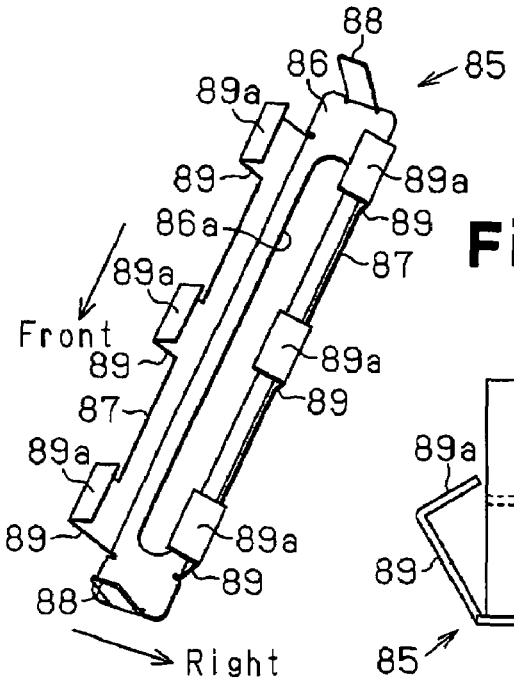
FIG. 9A is a perspective view illustrating a fixing member according to a seventh embodiment of the present invention.

FIG. 9A shows a fixing member 85 according to the seventh embodiment. The fixing member 85 has a rectangular base plate 86 extending along the front-and-back direction, a pair of rectangular gripping plates 87 provided at left and right sides of the base plate 86, and a pair of rectangular locking plates 88 provided at the front and rear ends of the base plate 86. A long hole 86*a* extending along the front-and-back direction is formed in a center of the base plate 86.

The gripping plates 87 can pivot relative to the base plate 86 using the joints between the gripping plates 87 and the base plate 86 as hinges. Plate-like arms 89 are formed at rear, center, and front portions of each gripping plate 87. Each arm 89 makes a pair with the corresponding arm 89 of the other gripping plate 87. The upper end of each arm 89 is bent perpendicularly inward to form a bent portion 89*a*. The locking plates 88 are formed by leaf springs and inclined outward.

Figure 9B:
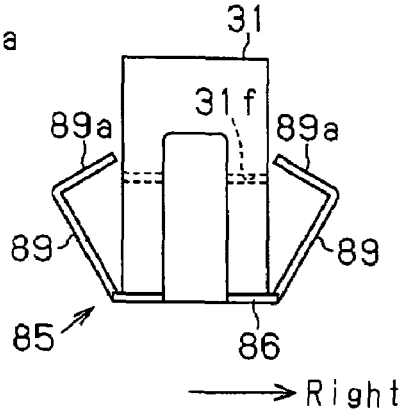
FIG. 9B is a side view showing a state in which an ink absorber is held by the fixing member of FIG. 9A.
Figure 9C:
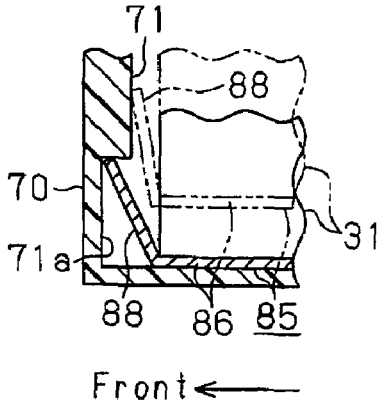
FIG. 9C is a cross-sectional view showing a state in which the fixing member of FIG. 9A holding the ink absorber is installed in the cap.

As shown in FIG. 9B, an ink absorber 31 according to the seventh embodiment is a rectangular parallelepiped having a shape that substantially corresponds to a cap recess 71. Also, the ink absorber 31 has insertion holes 31*f*. After placing the ink absorber 31 on the base plate 86 of the fixing member 85, the gripping plates 87 are pivoted inward so that the bent portions 89*a* of the arms 89 are inserted in the insertion holes 31*f*. The insertion holes 31*f* extend through the ink absorber 31 in the left-and-right direction. As shown in FIG. 9C, a cap of the present embodiment has no attachment pins 80 in the cap recesses 71. Instead, locking recesses 71*a* are formed in the front side and the rear side of the lower end of the cap recesses 71.

When accommodating the ink absorber 31 in the cap recesses 71, the ink absorber 31 is first located on the base plate 86, and the gripping plates 87 are pivoted inward. This causes the bent portions 89*a* of the arms 89 to be inserted into the insertion holes 31*f*, so that the ink absorber 31 is gripped by the arms 89 (in this embodiment, three pairs of the arms 89). Subsequently, with the ink absorber 31 gripped by the arms 89, the fixing member 85 is inserted in the cap recesses 71. Then, the locking plates 88 are flexed inward while being pressed by the front side and the rear side of the cap recess 71.

In this state, the fixing member 85 is further pressed into the cap recesses 71 until the lower surface of the base plate 86 contacts the inner bottom surface of the cap recesses 71. At this time, the locking plates 88, which have been flexed inward, restores the original state so that the locking plates 88 are locked to the locking recesses 71*a*. The locking prevents the fixing member 85 and the ink absorber 31 from moving upward. That is, the ink absorber 31 is fixed in the cap recess 71 by means of the fixing member 85.

In addition to the above described advantage (11), the seventh embodiment provides the following advantage.

(12) Since the ink absorber 31 is fixed in the cap recess 71 using the fixing member 85 after holding the ink absorber 31 by the fixing member 85, the installation of the ink absorber 31 to the cap 70 is facilitated. Particularly, when a thin and small ink absorber 31 is used, the ink absorber 31 is reliably prevented from being deformed at the time of insertion of the ink absorber 31 into the cap recesses 71. Therefore, the installation of the ink absorber 31 to the cap 70 is significantly facilitated.

An eighth embodiment of the present invention will now be described. The differences from the sixth embodiment will mainly be discussed.

Figure 10A:
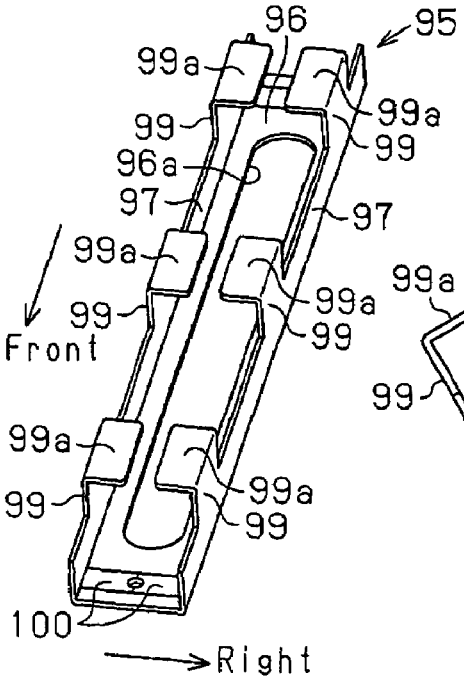
FIG. 10A is a perspective view illustrating a fixing member according to an eighth embodiment of the present invention.

FIG. 10A shows a fixing member 95 according to the eighth embodiment. The fixing member 95 has a rectangular base plate 96 extending along the front-and-back direction and a pair of rectangular gripping plates 97 provided at left and right sides of the base plate 96. The gripping plates 97 can pivot relative to the base plate 96 using the joints between the gripping plates 97 and the base plate 96 as hinges. Plate-like arms 99 are formed at rear, center, and front portions of each gripping plate 97. Each arm 99 makes a pair with the corresponding arm 99 of the other gripping plate 97. The upper end of each arm 99 is bent perpendicularly inward to form a bent portion 99*a*.

A long hole 96*a* extending along the front-and-back direction is formed in a center of the base plate 96. An H-shaped slit is formed in the base plate 96 at each of the front and rear ends to form a pair of rectangular locking portions 100. That is, the proximal ends of the locking portions 100 function as part of the joints between the gripping plates 97 and the base plate 96. The locking portions 100 can pivot using the proximal ends as hinges. A semicircular notch is formed in the distal end of each locking portion 100. The distal ends of the locking portions 100 contact each other. In this case, the semicircular notches at the distal ends of the locking portions 100 form a circular through hole.

Figure 10B:
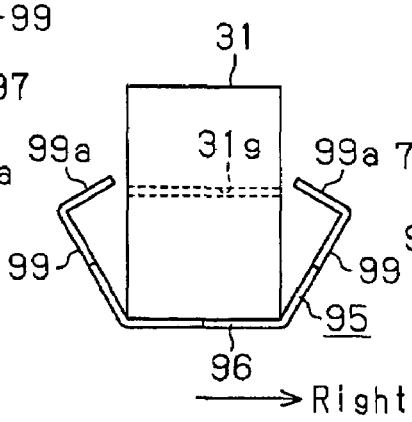
FIG. 10B is a side view showing a state in which an ink absorber is held by the fixing member of FIG. 10A.

As shown in FIG. 10B, an ink absorber 31 is a rectangular parallelepiped having a shape that substantially corresponds to a cap recess 71. Also, the ink absorber 31 has insertion holes 31*g*. After placing the ink absorber 31 on the base plate 96 of the fixing member 95, the gripping plates 97 are pivoted inward so that the bent portions 99*a* of the arms 99 are inserted in the insertion holes 31*g*. The insertion holes 31*g* extend through each ink absorber 31 in the left-and-right direction.

Figure 10C:
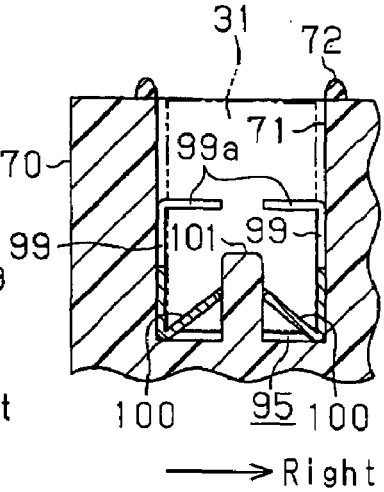
FIG. 10C is a cross-sectional view showing a state in which the fixing member of FIG. 10A holding the ink absorber is installed in the cap.

As shown in FIG. 10C, a cap 70 of the present embodiment has columnar insertion pins 101. Each insertion pin 101 is located at a position corresponding to one of the through holes formed by the distal notches of the locking portions 100 when the fixing member 95 is fixed in the cap recess 71. The outer diameter of each insertion pin 101 is larger than the through hole formed by the distal notches of the locking portions 100, and less than the width of the locking portions 100 along the front-and-back direction.

When accommodating the ink absorber 31 in the cap recesses 71, the ink absorber 31 is first located on the base plate 96, and the gripping plates 97 are pivoted inward. This causes the bent portions 99*a* of the arms 99 to be inserted into the insertion holes 31*g*, so that the ink absorber 31 is gripped by the arms 99 (in this embodiment, three pairs of the arms 99). Subsequently, with the ink absorber 31 gripped by the arms 99, the fixing member 95 is inserted in the cap recesses 71. When the fixing member 95 is inserted to the bottom of the cap recess 71, the lower surface of the base plate 96 contacts the inner bottom surface of the cap recess 71. At this time, each insertion pin 101 is pressed against the through hole formed by the distal notches of the corresponding locking portions 100. Accordingly, the distal ends of the locking portions 100 are pushed up by the insertion pin 101, so that the locking portions 100 pivot upward to open like double doors.

Then, the insertion pin 101 is, at the circumferential surface, held by the distal ends of the locking portions 100. In this state, if the ink absorber 31 is pulled upward together with the fixing member 95, the locking portions 100 pivot downward (in a direction further tightly holding the insertion pin 101). That is, the ink absorber 31, together with the fixing member 95, is prevented from moving upward. Therefore, the ink absorber 31 is fixed in the cap recess 71 by means of the fixing member 95.

The eighth embodiment provides the same advantage as the above described advantages (11) and (12).

The first to eighth embodiments may be modified as follows.

In the first and second embodiments, the piercing holes 31*a* formed in the ink absorber 31 may be replaced by piercing recesses that do not extend through the ink absorber 31.

In the first embodiment, the number of the barb portions 29 on the piercing portions 27, 28 of the piercing member 25 may be any number.

In the first embodiment, the base 26 of the piercing member 25 may be omitted, and the piercing portions 27, 28 may be integrally formed with the inner bottom surface of the cap 23. Compared to the case where the piercing portions 27, 28 are formed separately and attached to the inner bottom surface of the cap 23, the accuracy of the height of the piercing portions 27, 28 from the inner bottom surface of the cap 23 is improved.

In the first embodiment, the piercing member 25 may be omitted, and barb portions 29 may be provided on the inner side surface of the cap 23. In this case, the barb portions 29 formed on the inner side surface of the cap 23 function as fixing members.

In the first embodiment, the upper ends of the left and right piercing portions 27, 28 of the piercing member 25 may be at the same height as the upper surface of the ink absorber 31.

In the second embodiment, the upper ends of the piercing portions 49 may be at the same height as the upper surface of the ink absorber 31.

In the third embodiment, the rear bent portion of the holding member 57 may have a barb portion as that of the front bent portion 58.

In the fourth embodiment, the upper surface of the inner flange 60*a* of the holding member 60 may be lower than the upper surface of the ink absorber 31. This configuration provides the same advantages as the above described advantages (1) to (5).

In the first to eighth embodiments, the liquid ejection apparatus is embodied as the inkjet printer 11. However, for example, the present invention may be embodied as a liquid ejection apparatus used for manufacturing color filters for liquid crystal displays or pixels of organic EL displays.

A ninth embodiment of the present invention will now be described with reference to FIGS. 11 to 14C.

Figure 11:
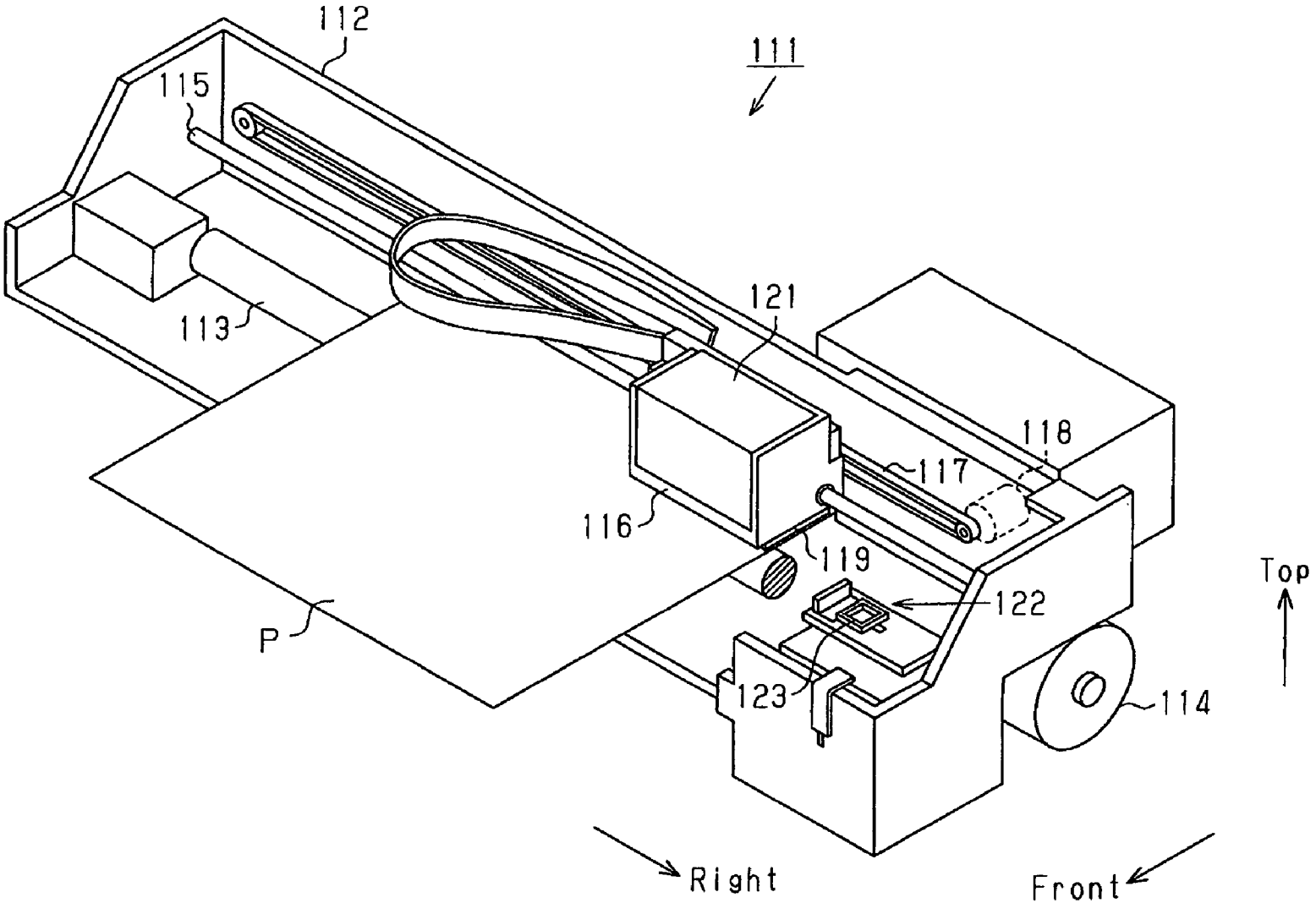
FIG. 11 is a perspective view illustrating an inkjet printer according to a ninth embodiment of the present invention.

As shown in FIG. 11, an inkjet printer 111, which functions as a liquid ejection apparatus, has a frame 112, which has a rectangular shape as viewed from above. A platen 113 is provided in the frame 112. A paper feed mechanism having a paper feed motor 114 feeds sheets of recording paper P onto the platen 113. A rod-like guide member 115 is supported also by the frame 112 and extends parallel with the longitudinal direction of the platen 113.

A carriage 116 is supported by the guide member 115, which is passed through the carriage 116, so that the carriage 116 reciprocates along the axial direction of the guide member 115. The carriage 116 is connected to a carriage motor 118 located rearward of the frame 112 through a timing belt 117 that is provided on a rear inner wall of the frame 112. When the carriage motor 118 runs, the carriage 116 reciprocates along the guide member 115.

A recording head 119, or a liquid ejection head, is mounted on a bottom surface of the carriage 116. The lower surface of the recording head 119 functions as a nozzle-forming surface 119*a*, in which a number of nozzle rows 120 are provided. The nozzle rows 120, the number of which is four in this embodiment, are arranged along the front-and-back direction, and each nozzle row 120 has a number of nozzles (see FIG. 12). A detachable ink cartridge 121 is mounted on the carriage 116 above the recording head 119. The ink cartridge 121 stores inks of two or more colors (in this embodiment, four colors). The inks of different colors are supplied to the recording head 119.

The recording head 119 has piezoelectric elements (not shown). When activated, the piezoelectric elements supplies ink from each ink cartridge 121 to the recording head 119. The ink is ejected from the nozzle rows 120 (nozzles) onto the recording paper sheet P fed to the platen 113. Printing is thus performed. A capping device 122 is provided in a non-printing area at a right end portion of the frame 112. The capping device 122 seals the nozzle-forming surface 119*a* of the recording head 119 in a non-printing state.

Figure 12:
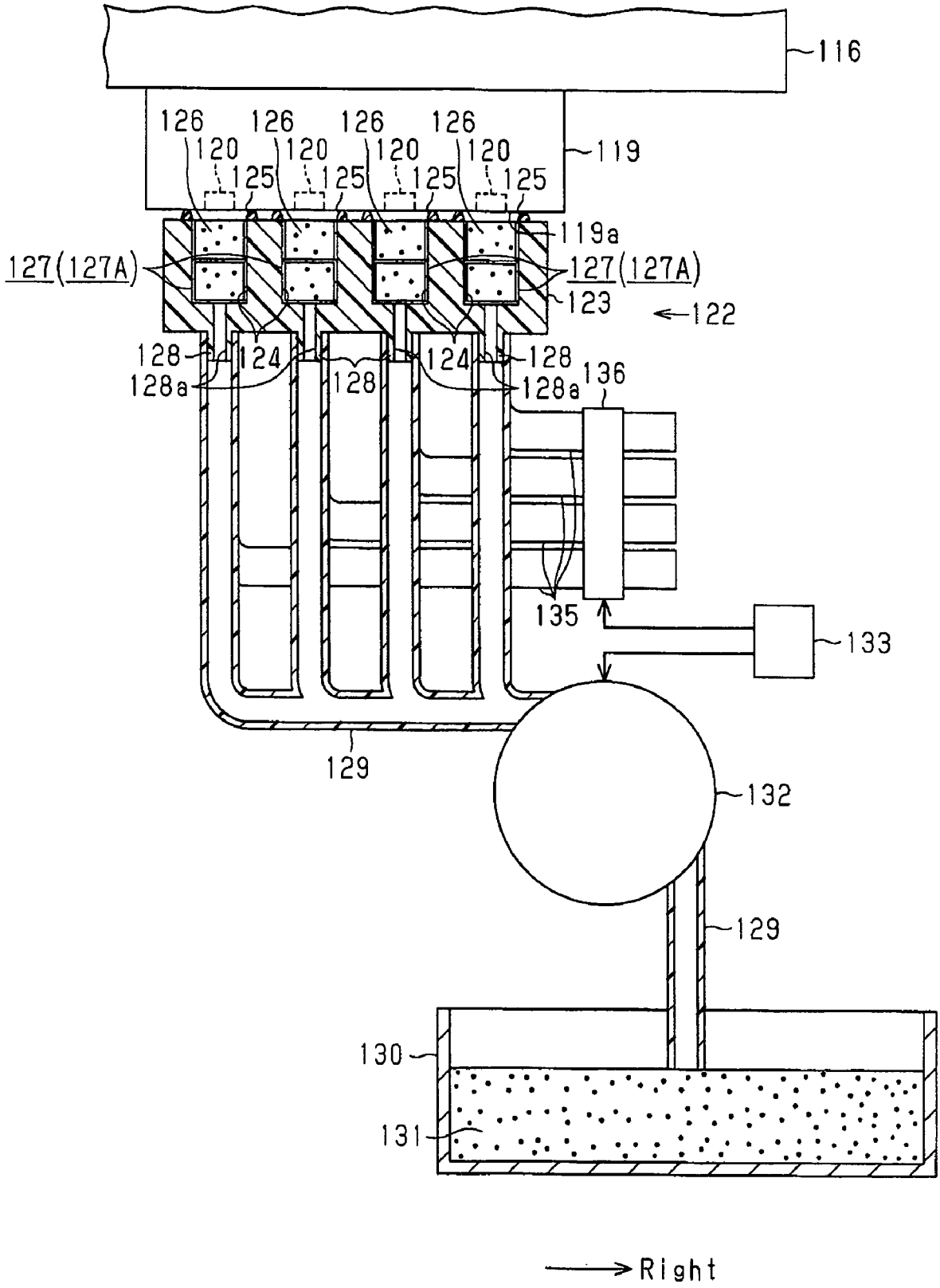
FIG. 12 is a schematic cross-sectional view showing a part of the printer of FIG. 11.
Figure 13:
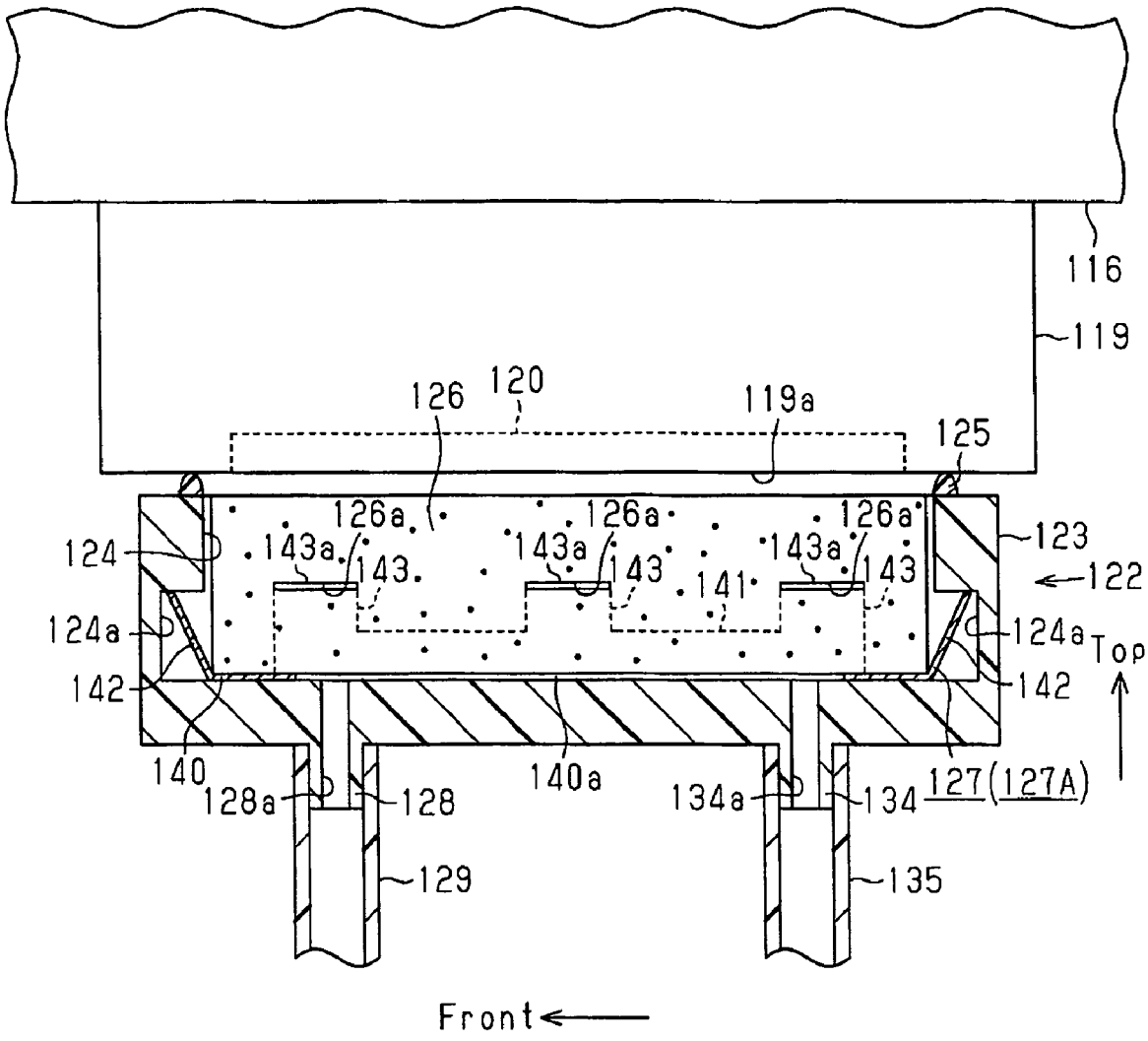
FIG. 13 is an enlarged partial cross-sectional view of FIG. 12.

As shown in FIGS. 12 and 13, the capping device 122 has a synthetic resin cap 123 capable of sealing the nozzle-forming surface 119*a* of the recording head 119. When sealing the nozzle-forming surface 119*a*, the cap 123 contacts the recording head 119 in such a manner as to encompass the nozzles 120. The cap 123 is substantially shaped as a rectangular parallelepiped as a whole. Four cap recesses 124 are formed in the upper surface of the cap 123 along the left-and-right direction to correspond to the four nozzle rows 120. Annular sealing members 125 made of a flexible material such as rubber project on the upper surface of the cap 123 to surround each cap recess 124.

A locking recess 124*a* is formed in each of a front surface and a rear surface of the lower end portion of each cap recess 124. A rectangular parallelepiped ink absorber 126, or a liquid absorber the shape of which substantially corresponds to the shape of the cap recesses 124, is installed in each cap recess 124 by means of a main body 127A of an installation device 127. The ink absorber 126 is made of a flexible porous material, and the installation device main body 127A is made of metal.

When the carriage 116 is in the non-printing area, the capping device 122 lifts the cap 123 using a lift mechanism (not shown), so that the upper end of the sealing member 125 contacts the nozzle-forming surface 119*a* of the recording head 119. The nozzles 120 are thus sealed with the cap 123. When the cap 123 seals the nozzle-forming surface 119*a*, the ink absorber 126 retaining ink in the cap 123 maintains moisture in the cap 123.

Drainage portions 128 for draining ink in the cap 123 project downward from the bottom wall of the cap 123 at positions corresponding to the cap recesses 124. A drainage passage 128*a* is defined in each drainage portion 128. A proximal end (upstream end) of a drainage tube 129 made of a flexible material is connected to each drainage portion 128. The drainage passage 128*a* connects the interior of the cap 123 with the interior of the drainage tube 129.

The drainage tubes 129 are merged into one tube at a position toward the distal ends (downstream ends). A distal end (downstream end) of the merged single drainage tube 129 is placed in a rectangular box-shaped waste ink tank 130 having an open upper end. A rectangular parallelepiped waste ink absorber 131 made of a flexible porous material is accommodated in the waste ink tank 130.

A tube pump 132 is provided in a portion of the drainage tubes 129 that is downstream of the merging point of the tubes 129. The tube pump 132 sends ink and bubbles in the ink from the cap 123 to the waste ink tank 130. The tube pump 132 is electrically connected to a control section 133, which controls the operation state of the inkjet printer 111, such that the tube pump 132 is controlled by the control section 133.

Then, with the nozzle-forming surface 119*a* (the nozzle rows 120) of the recording head 119 being sealed with the cap 123, the tube pump 132 is activated so that viscous ink is drawn out of the nozzle rows 120 together with bubbles. The ink and bubbles are drained to the waste ink tank 130 through the cap 123 and the drainage tubes 129. This process is referred to as head cleaning.

Atmosphere communicating portions 134 for connecting the interior of the cap 123 with the outside (atmosphere) project downward from the bottom wall of the cap 123 at positions corresponding to the cap recesses 124. An atmosphere communicating passage 134*a* is defined in each atmosphere communicating portion 134. In this case, the atmosphere communicating portions 134 are arranged at predetermined intervals in positions rearward of the drainage portions 128. A proximal end of an atmosphere communicating tube 135 made of a flexible material is connected to each atmosphere communicating portion 134. The atmosphere communicating passages 134*a* connect the interior of the cap 123 with the interior of the atmosphere communicating tubes 135.

An atmosphere communicating valve 136 is provided at the distal end of each atmosphere communicating tube 135. The atmosphere communicating valve 136 is electrically connected to the control section 133. The control section 133 controls the atmosphere communicating valve 136. When the atmosphere communicating valve 136 is open, the interior of the atmosphere communicating tube 135 communicates with the atmosphere. When the atmosphere communicating valve 136 is closed, the interior of the atmosphere communicating tube 135 is disconnected from the atmosphere.

Next, the main bodies 127A of the installation devices 127 and the ink absorbers 126 will be described.

Figure 14A:
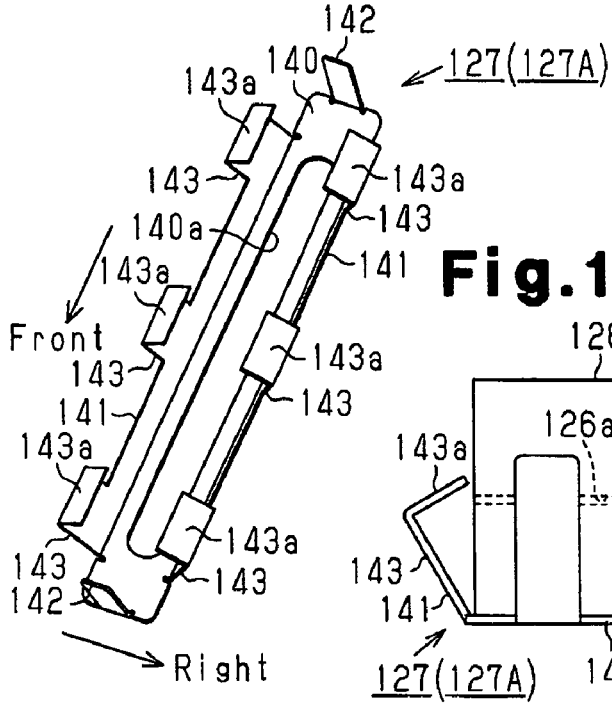
FIG. 14A is a perspective view illustrating an installation device main body of the printer of FIG. 11.

FIG. 14A shows an installation device main body 127A. The installation device main body 127A has a rectangular base plate 140 extending along the front-and-back direction, a pair of rectangular gripping plates 141 provided at left and right sides of the base plate 140, and a pair of rectangular locking plates 142 provided at the front and rear ends of the base plate 140. The base plate 140 and the gripping plates 141 function as holding portions. The locking plates 142 function as fixing portions. The locking plates 142 are formed by leaf springs and inclined outward. A long hole 140*a* extending along the front-and-back direction is formed in a center of the base plate 140.

The gripping plates 141 can pivot (be displaced) relative to the base plate 140 using the joints between the gripping plates 141 and the base plate 140 as hinges. Plate-like arms 143 are formed at rear, center, and front portions of each gripping plate 141. Each arm 143 makes a pair with the corresponding arm 143 of the other gripping plate 141 and functions as a holding piece. The upper end of each arm 143 is bent perpendicularly inward to form a bent portion 143*a*. In this embodiment, each installation device main body 127A has three pairs of the arms 143.

Figure 14B:
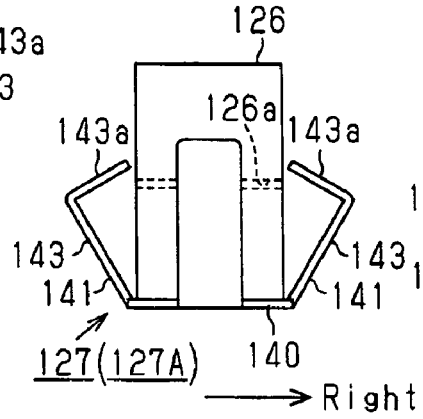
FIG. 14B is a side view showing a state in which an ink absorber is held by the installation device main body of FIG. 14A.
Figure 14C:
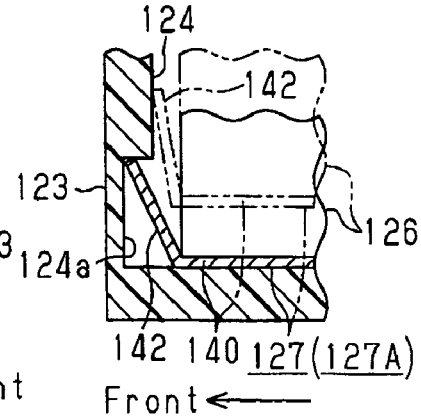
FIG. 14C is a cross-sectional view showing a state in which the installation device main body of FIG. 14A holding the ink absorber is installed in a cap recess.

As shown in FIG. 14B, an ink absorber 126 has insertion holes 126*a*. After placing the ink absorber 126 on the base plate 140 of the installation device main body 127A, the gripping plates 141 are pivoted inward so that the bent portions 143*a* of the arms 143 are inserted in the insertion holes 126*a*. The insertion holes 126*a* extend through the ink absorber 126 in the left-and-right direction.

A method for installing the ink absorber 126 in the cap recess 124 using the installation device main body 127A will now be described.

When attaching the ink absorber 126 into the cap recess 124, the ink absorber 126 is placed on the base plate 140 with the gripping plates 141 (the arms 143) of the installation device main body 127A pivoted outward (non-holding state in which the ink absorber 126 is not held; the state shown in FIG. 14B). Subsequently, the gripping plates 141 are pivoted inward so that the bent portions 143*a* of the arms 143 are inserted into the insertion holes 126*a* of the ink absorber 126. Accordingly, the ink absorber 126 is gripped by the arms 143 (holding state in which the ink absorber 126 is held).

Subsequently, with the ink absorber 126 gripped by the arms 143, the installation device main body 127A is inserted in the cap recesses 124. Then, the locking plates 142 are flexed inward as shown by two-dot chain lines in FIG. 14C, while being pressed by the front side and the rear side of the cap recess 124.

In this state, the installation device main body 127A is further pressed into the cap recesses 124 until the lower surface of the base plate 140 contacts the inner bottom surface of the cap recesses 124. At this time, the locking plates 142, which have been flexed inward, restores the original state due to its own elastic restoring force, so that the locking plates 142 are locked to the locking recesses 124*a*. The locking by the locking plates 142 prevents the installation device main body 127A and the ink absorber 126 from moving upward. That is, the ink absorber 126 is installed in the cap recess 124 by means of the installation device main body 127A.

As shown in FIG. 13, in the state in which the ink absorber 126 is fixed in the cap recess 124 by means of the installation device main body 127A, the front end of the long hole 140*a* of the base plate 140 agrees with the position of the drainage passage 128*a*, and the rear end of the long hole 140*a* of the base plate 140 agrees with the position of the atmosphere communicating passage 134*a*.

The ninth embodiment has the following advantages.

(13) The ink absorber 126 is installed in the cap recess 124 by means of the installation device main body 127A while being held by the installation device main body 127A. This configuration prevents the ink absorber 126 from being deformed when the ink absorber 126 is inserted into the cap recess 124. Therefore, the installation of the ink absorber 126 into the cap recess 124 can be easily and smoothly performed. Further, the installation device main body 127A is fixed in the cap recess 124 while holding the ink absorber 126. Thus, installation device main body 127A reliably prevents the ink absorber 126 from being raised in the cap recess 124.

(14) The installation device main body 127A is configured to pivot between a state for holding the ink absorber 126 (state where the gripping plates 141 are pivoted outward) and a state not for holding the ink absorber 126 (state were the holding plates are pivoted inward). Therefore, after placing the ink absorber 126 on the base plate 140 while setting the installation device main body 127A to the non-holding state, the ink absorber 126 can be easily held by the installation device main body 127A by pivoting the installation device main body 127A to the holding state.

(15) When in a state for holding the ink absorber 126, the installation device main body 127A gripes the ink absorber 126 using the arms 143. This allows the ink absorber 126 to be reliably and firmly held.

(16) The installation device main body 127A is fixed in the cap recess 124 by locking the locking plates 142 by the locking recesses 124*a* in the cap recess 124. Thus, unlike the JP-A-2000-62202, the installation device main body 127A does not need to be fixed in the cap recess 124 through complicated heat crimping procedure.

A tenth embodiment of the present invention will now be described. The differences from the ninth embodiment will mainly be discussed.

Figure 15A:
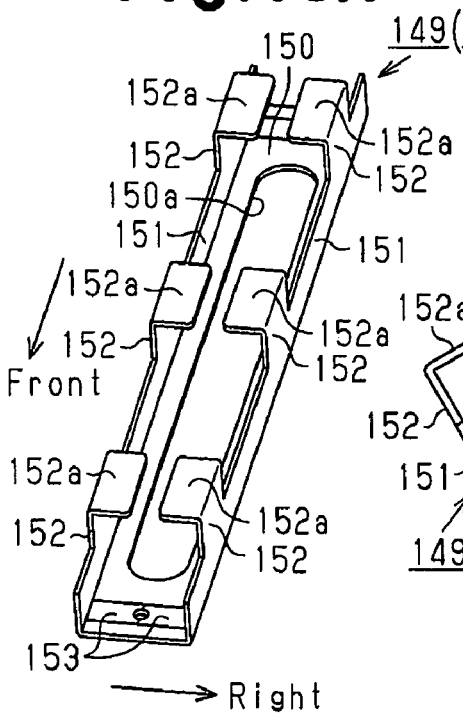
FIG. 15A is a perspective view illustrating an installation device main body according to a tenth embodiment of the present invention.

FIG. 15A shows a main body 149A of an installation device 149 according to the tenth embodiment. The installation device main body 149A has a rectangular base plate 150 extending along the front-and-back direction, a pair of rectangular gripping plates 151 provided at left and right sides of the base plate 150. The base plate 150 and the gripping plates 151 function as holding portions. The gripping plates 151 can pivot (be displaced) relative to the base plate 150 using the joints between the gripping plates 151 and the base plate 150 as hinges.

Plate-like arms 152 are formed at rear, center, and front portions of each gripping plate 151. Each arm 152 makes a pair with the corresponding arm 152 of the other gripping plate 151 and functions as a holding piece. The upper end of each arm 152 is bent perpendicularly inward to form a bent portion 152*a*. In this embodiment, each installation device main body 149A has three pairs of the arms 152.

A long hole 150*a* extending along the front-and-back direction is formed in a center of the base plate 150. An H-shaped slit is formed in the base plate 150 at each of the front and rear ends to form a pair of rectangular locking portions 153 formed as a rectangular cut piece. The locking portions 153 function as fixing portions. That is, the proximal ends of the locking portions 153 function as part of the joints between the gripping plates 151 and the base plate 150. The locking portions 153 can pivot using the proximal ends as hinges.

Figure 15B:
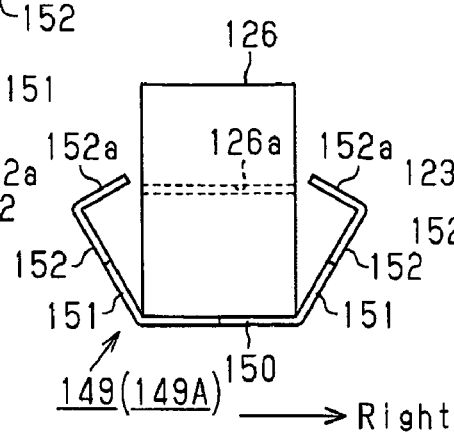
FIG. 15B is a side view showing a state in which an ink absorber is held by the installation device main body of FIG. 15A.

A semicircular notch is formed in the distal end of each locking portion 153. The distal ends of the locking portions 153 contact each other. In this case, the semicircular notches at the distal ends of the locking portions 153 form a circular through hole. As shown in FIG. 15B, an ink absorber 126 has insertion holes 126*a*. After placing the ink absorber 126 on the base plate 150, the gripping plates 151 are pivoted inward so that the bent portions 152*a* of the arms 152 are inserted in the insertion holes 126*a*.

Figure 15C:
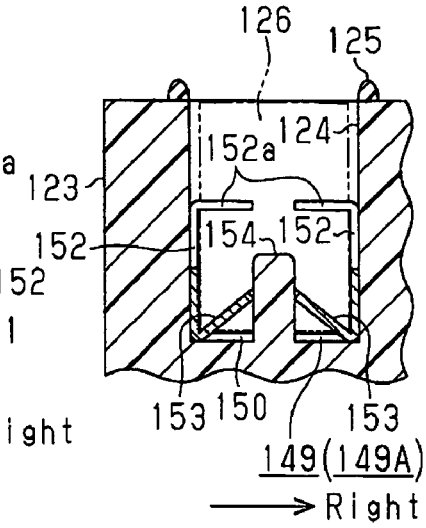
FIG. 15C is a cross-sectional view showing a state in which the installation device main body of FIG. 15A holding the ink absorber is installed in a cap recess.

As shown in FIG. 15C, a cap 123 of the present embodiment has columnar insertion pins 154 on the inner bottom surface of the cap recess 124. Each insertion pin 154 is located at a position corresponding to one of the through holes formed by the distal notches of the locking portions 153 when the installation device main-body 149A is fixed in the cap recess 124. The outer diameter of each insertion pin 154 is larger than the through hole formed by the distal notches of the locking portions 153, and less than the width of the locking portions 153 along the front-and-back direction.

When attaching the ink absorber 126 into the cap recess 124, the ink absorber 126 is placed on the base plate 150 with the gripping plates 151 (the arms 152) of the installation device main body 149A pivoted outward (non-holding state in which the ink absorber 126 is not held; the state shown in FIG. 15B). Subsequently, the gripping plates 151 are pivoted inward so that the bent portions 152*a* of the arms 152 are inserted into the insertion holes 126*a* of the ink absorber 126. Accordingly, the ink absorber 126 is gripped by the arms 152 (holding state in which the ink absorber 126 is held).

Subsequently, with the ink absorber 126 gripped by the arms 152, the installation device main body 149A is inserted in the cap recess 124. When the installation device main body 149A is inserted to the bottom of the corresponding cap recess 124, the lower surface of the base plate 150 contacts the inner bottom surface of the cap recess 124. At this time, each insertion pin 154 is pressed against the through hole formed by the distal notches of the corresponding locking portions 153. Accordingly, the distal ends of the locking portions 153 are pushed up by the insertion pin 154, so that the locking portions 153 pivot upward to open like double doors.

Then, the insertion pin 154 is, at the circumferential surface, held by the distal ends of the locking portions 153. In this state, if the ink absorber 126 is pulled upward together with the installation device main body 149A, the locking portions 153 pivot downward (in a direction further tightly holding the insertion pin 154). That is, the ink absorber 126, together with the installation device main body 149A, is prevented from moving upward. That is, the ink absorber 126 is fixed in the cap recess 124 by means of the installation device main body 149A.

The tenth embodiment provides the same advantage as the above described advantages (13) to (16).

An eleventh embodiment of the present invention will now be described. The differences from the ninth embodiment will mainly be discussed.

Figure 16A:
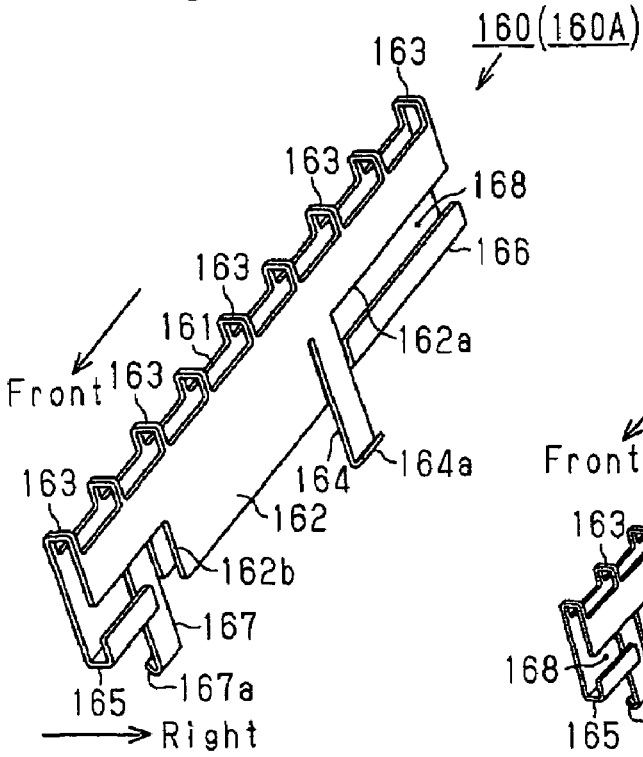
FIG. 16A is a perspective view illustrating an installation device main body according to an eleventh embodiment of the present invention.

As shown in FIG. 16A, a main body 160A of an installation device 160 according to the eleventh embodiment has a substantially rectangular left base plate 161, a substantially rectangular right base plate 162 arranged on the right side of and parallel to the left base plate 161, a plurality of coupling members 163 (the number is nine in the preset embodiment) that couples the left and right base plates 161, 162 at the upper ends.

Each coupling member 163 has an inverted U-shaped as viewed from the front. One end of the coupling member 163 is connected to the left base plate 161, and the other end is connected to the right base plate 162. The coupling members 163 are arranged in the entire upper ends of the left and right base plates 161, 162 at equal intervals along the front-and-back direction.

A long rectangular rear cutout portion 162*a* is formed in a rear portion of the right base plate 162 ranging downward from a midway section in the up-and-down direction. Also, a short rectangular front cutout portion 162*b* is formed in a front portion of the right base plate 162 ranging downward from a midway section in the up-and-down direction. A right hook piece 164 extends downward from an upper front end of the rear cutout portion 162*a* of the right base plate 162. The lower end of the right hook piece 164 is bent rightward and diagonally upward to form a right hook portion 164*a*, which functions as a fixing portion.

A front support plate 165 extends toward the right base plate 162 from the lower front end of the left base plate 161. The front support plate 165 is laterally-facing L-shaped as viewed from the front. That is, the front support plate 165 first extends laterally from the lower front end of the left base plate 161, and is then bent perpendicularly upward at a position corresponding to the front cutout portion 162*b* of the right base plate 162. The distal end (upper end) of the front support plate 165 faces the upper end of the front cutout portion 162*b* of the right base plate 162. A predetermined gap extending along the front-and-back direction exists between the distal end (upper end) of the front support plate 165 and the upper end of the cutout portion 162*b* of the right base plate 162.

A rear support plate 166 extends toward the right base plate 162 from the lower rear end of the left base plate 161. The rear support plate 166 is laterally-facing L-shaped as viewed from the front. That is, the rear support plate 166 first extends laterally from the lower rear end of the left base plate 161, and is then bent perpendicularly upward at a position corresponding to the rear cutout portion 162*a* of the right base plate 162. The distal end (upper end) of the rear support plate 166 faces the upper end of the rear cutout portion 162*a* of the right base plate 162. A predetermined gap extending along the front-and-back direction exists between the distal end (upper end) of the rear support plate 166 and the upper end of the rear cutout portion 162*a* of the right base plate 162.

A short rectangular left hook piece 167 is formed by cutting a front portion of the left base plate 161 that is rearward of the front support plate 165. The left hook piece 167 extends downward. The lower end of the left hook piece 167 is bent leftward and diagonally upward to form a left hook portion 167*a*, which functions as a fixing portion. The installation device main body 160A of the installation device 160 of the present embodiment has an insertion portion 168 functioning as a holding portion. Specifically, the insertion portion 168 is a space having a rectangular cross-section defined by the left base plate 161, the right base plate 162, the coupling members 163, the front support plate 165, and the rear support plate 166.

Figure 16B:
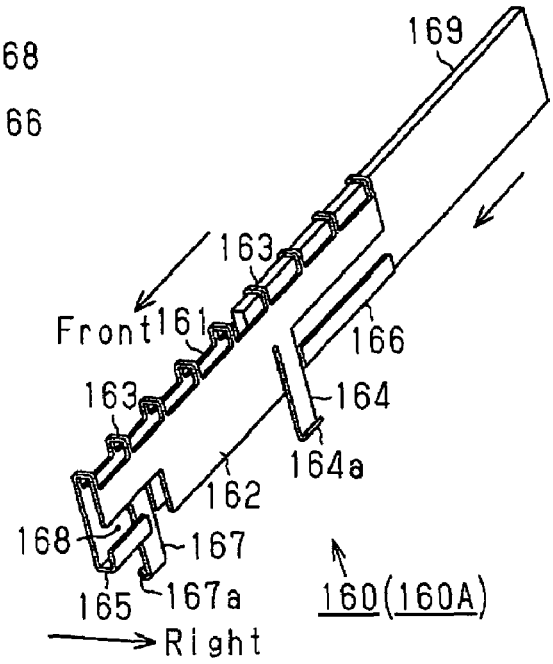
FIG. 16B is a perspective view showing a state in which an ink absorber is inserted into an insertion portion of the installation device main body of FIG. 16A.

As shown in FIG. 16B, an ink absorber 169 of the eleventh embodiment is formed as a rectangular plate the shape of which corresponds to the insertion portion 168 of the installation device main body 160A. The ink absorber 169 is slid into the insertion portion 168 through an end opening of the installation device main body 160A (rear opening as viewed in FIG. 16B). The thickness of the ink absorber 169 along the left-and-right direction is approximately half the thickness of the above described ink absorber 126 along the left-and-right direction.

Figure 16C:
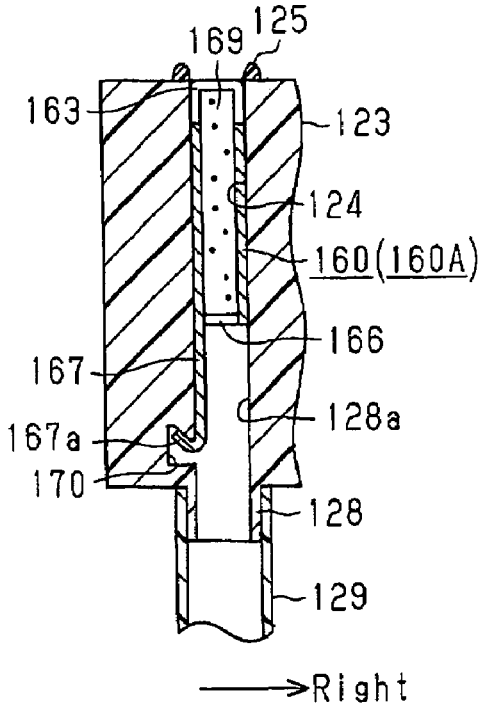
FIGS. 16C and 16D are cross-sectional views showing a state in which the installation device main body of FIG. 16A holding the ink absorber is installed in a cap recess.
Figure 16D:
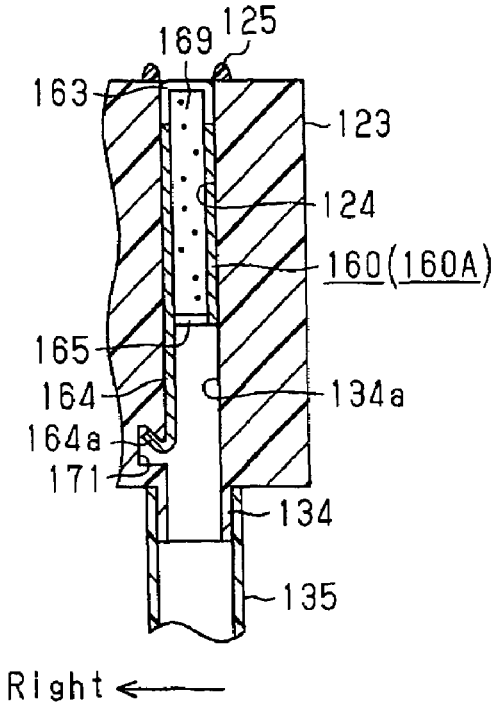

As shown in FIGS. 16C and 16D, a cap recess 124 of a cap 123 according to the eleventh embodiment has a cross-sectional shape that corresponds to that of the installation device main body 160A. When the installation device main body 160A is inserted in the cap recess 124, the left hook piece 167 is inserted in the drainage passage 128*a*, and the right hook piece 164 is inserted in an atmosphere communicating passage 134*a*.

Further, a left hook recess 170 is formed on a left surface in the drainage passage 128*a*. When the left hook piece 167 is inserted in the drainage passage 128*a*, the left hook portion 167*a* is hooked (locked) to the left hook recess 170. Also, a right hook recess 171 is formed on a right surface in the atmosphere communicating passage 134*a*. When the right hook piece 164 is inserted in the atmosphere communicating passage 134*a*, the right hook portion 164*a* is hooked (locked) to the right hook recess 171.

When installing the ink absorber 169 in the cap recess 124, the ink absorber 169 is first slid in the insertion portion 168 from the rear opening of the installation device main body 160A along the front-and-rear direction, such that the ink absorber 169 is held by the installation device main body 160A. Subsequently, the installation device main body 160A is inserted in the cap recess 124 from above. In this case, the direction along which the installation device main body 160A is inserted in the cap recess 124 is perpendicular to the direction along which the ink absorber 169 is slid into the insertion portion 168 through the rear opening of the installation device main body 160A.

Then, the left hook portion 167*a* of the left hook piece 167 is hooked to the left hook recess 170, and the right hook portion 164*a* of the right hook piece 164 is hooked to the right hook recess 171. This prevents the installation device main body 160A and the ink absorber 169 from being raised. That is, the ink absorber 169 is fixed in the cap recess 124 by means of the installation device main body 160A.

In addition to the above described advantages (13) to (16), the eleventh embodiment provides the following advantages.

(17) The installation device main body 160A has the insertion portion 168 into which the ink absorber 169 is slid. This permits the ink absorber 169 to be held by the insertion portion 168 without being damaged.

(18) The direction along which the installation device main body 160A is inserted in the cap recess 124 is perpendicular to the direction along which the ink absorber 169 is slid into the insertion portion 168 through the rear opening of the installation device main body 160A. Thus, after the installation device main body 160A is inserted and fixed in the cap recess 124, the ink absorber 169 cannot be easily removed.

(19) When the installation device main body 160A is inserted in the cap recess 124, the left hook portion 167*a* of the left hook piece 167 is hooked to the left hook recess 170, and the right hook portion 164*a* of the right hook piece 164 is hooked to the right hook recess 171. Thus, the installation device main body 160A is easily installed in the cap recess 124.

The ninth to eleventh embodiments may be modified as follows.

In the ninth embodiment, the installation device main body 127A may have one, two, or four or more pairs of arms 143.

In the tenth embodiment, the installation device main body 149A may have one, two, or four or more pairs of arms 152.

In the eleventh embodiment, the ink absorber 169 may be slid into the insertion portion 168 of the installation device main body 160A through a front opening of the installation device main body 160A.

The fixing portions of the ninth embodiment, which are formed by the locking plates 142, may be formed by the locking portions 153 of the tenth embodiment, or the left and right hook portions 164*a*, 167*a* of the eleventh embodiment.

The fixing portions of the tenth embodiment, which are formed by the locking portions 153, may be formed by the locking plates 142 of the ninth embodiment, or the left and right hook portions 164*a*, 167*a* of the eleventh embodiment.

The fixing portions of the eleventh embodiment, which are formed by the left and right hook portions 164*a*, 167*a*, may be formed by the locking plates 142 of the ninth embodiment, or the locking portions 153 of the tenth embodiment.

In the ninth to eleventh embodiments, the liquid ejection apparatus is embodied as the inkjet printer 111. However, for example, the present invention may be embodied as a liquid ejection apparatus used for manufacturing color filters for liquid crystal displays or pixels of organic EL displays.

What is claimed is:

1. A capping device provided in a liquid ejection apparatus having a liquid ejection head, the liquid ejection head having a nozzle-forming surface in which a nozzle for ejection liquid is formed, the capping device comprising:

a cap capable of contacting the liquid ejection head in such a manner as to encompass the nozzle;

a liquid absorber accommodated in the cap; and a fixing member for fixing the liquid absorber accommodated in the cap to the cap, the fixing member comprising a base plate and a pair of liquid absorber gripping plates connected to the base plate, each gripping plate being pivotable relative to the base plate, wherein the fixing member is arranged in the cap such that an upper end of the fixing member is at the same height as or lower than an upper surface of the liquid absorber.

2. The capping device according to claim 1, wherein the fixing member is arranged in the cap such that the upper end of the fixing member is lower than the upper surface of the liquid absorber.

3. The capping device according to claim 1, wherein a portion of the fixing member is locked to the liquid absorber such that the liquid absorber is prevented from moving upward.

4. The capping device according to claim 3, wherein each gripping plate of the fixing member includes at least one piercing portion that pierces the liquid absorber when the gripping plates pivot towards the liquid absorber.

5. The capping device according to claim 4, wherein the liquid absorber has a recess or a hole that allows insertion of the piercing portion when the piercing portion pierces the liquid absorber.

6. The capping device according to claim 3, wherein the liquid absorber is fixed to the cap by the fixing member after being locked by the fixing member.

7. The capping device according to claim 1, wherein the fixing member further comprises a locking portion.

8. The capping device according to claim 7, wherein the locking portion comprises a pair of locking plates that extend from the base plate, the locking plates formed to lock with respective locking recesses of the cap.

9. The liquid ejection apparatus according to claim 7, wherein the locking portion comprises a pair of locking plates that are pivotable with respect to the base plate.

10. A liquid ejection apparatus comprising a liquid ejection head and a capping device, the liquid ejection head having a nozzle-forming surface in which a nozzle for ejection liquid is formed, wherein the capping device includes:

a cap capable of contacting the liquid ejection head in such a manner as to encompass the nozzle;

a liquid absorber accommodated in the cap; and a fixing member for fixing the liquid absorber accommodated in the cap to the cap, the fixing member comprising a base plate and a pair of liquid absorber gripping plates connected to the base plate, each gripping plate being pivotable relative to the base plate, wherein the fixing member is arranged in the cap such that an upper end of the fixing member is at the same height as or lower than an upper surface of the liquid absorber.

11. The liquid ejection apparatus according to claim 10, wherein the fixing member further comprises a locking portion.

12. The liquid ejection apparatus according to claim 11, wherein the locking portion comprises a pair of locking plates that extend from the base plate, the locking plates formed to lock with respective locking recesses of the cap.

13. The liquid ejection apparatus according to claim 11, wherein the locking portion comprises a pair of locking plates that are pivotable with respect to the base plate.

* * * * *